US009353547B2

(12) United States Patent
Tien

(10) Patent No.: US 9,353,547 B2
(45) Date of Patent: May 31, 2016

(54) OUTER OPERATING DEVICE FOR A DOOR LOCK

(71) Applicant: I-Tek Metal Mfg. Co., Ltd, Tainan (TW)

(72) Inventor: Hung-Jen Tien, Tainan (TW)

(73) Assignee: I-Tek Metal Mfg. Co., Ltd, Tainan (TW)

( * ) Notice: Subject to any disclaimer, the term of this patent is extended or adjusted under 35 U.S.C. 154(b) by 99 days.

(21) Appl. No.: 14/507,902

(22) Filed: Oct. 7, 2014

(65) Prior Publication Data

US 2016/0097218 A1 Apr. 7, 2016

(51) Int. Cl.

| | |
|---|---|
| ***E05B 3/00*** | (2006.01) |
| ***E05B 9/00*** | (2006.01) |
| ***E05B 15/00*** | (2006.01) |
| *E05B 13/00* | (2006.01) |
| *E05B 17/04* | (2006.01) |

(52) U.S. Cl.

CPC . *E05B 3/00* (2013.01); *E05B 9/002* (2013.01); *E05B 15/0013* (2013.01); *E05B 13/005* (2013.01); *E05B 17/04* (2013.01); *Y10T 70/5792* (2015.04)

(58) Field of Classification Search

CPC ..... E05B 17/04; E05B 13/005; E05B 13/00; E05B 13/002; E05B 13/101; E05B 81/16; E05B 85/18; E05B 77/30; E05B 65/10; E05B 3/00; E05B 15/0013; E05B 9/002; Y10T 70/5832; Y10T 70/5761; Y10T 70/7073; Y10T 70/5341; Y10T 70/5792; Y10T 70/7136; Y10T 70/5469; Y10T 70/5159; E05C 9/041; E05C 9/021; E05C 1/14; E05C 3/162

USPC ..... 70/92, 207–210, 215–217, 224, 379 R, 70/380; 292/92, 336.3

See application file for complete search history.

(56) References Cited

U.S. PATENT DOCUMENTS 1,555,829 A * 10/1925 Carroll ..... E05B 65/1066 70/92
1,564,030 A * 12/1925 Soemer ..... E05B 65/1066 292/92

(Continued)

*Primary Examiner* — Suzanne Barrett
(74) *Attorney, Agent, or Firm* — Alan D. Kamrath; Kamrath IP Lawfirm, P.A.

(57) ABSTRACT

An outer operating device for a door lock includes a mounting plate mounted to an outer side of a door. A driving wheel is pivotably mounted in a mounting seat fixed to the mounting plate. A driving member is pivotably mounted in the mounting seat and meshes with the driving wheel. A distal end of the driving member is operably connected to a latch of a latch device. A handle is pivotably mounted to the mounting seat and includes a lever. A movable block is slideably received in the driving wheel and includes a notch. When a pressing end of the lever is not aligned with the notch of the movable block, the latch can be retracted to an unlatching position by pivoting the handle. When the notch is aligned with the notch of the movable block, the latch cannot be retracted by pivoting the handle.

5 Claims, 21 Drawing Sheets

(56) References Cited

U.S. PATENT DOCUMENTS 2,156,513 A * 5/1939 Roedding ..... E05B 65/0042 292/205
4,546,628 A * 10/1985 Takasaki ..... E05B 65/0053 292/92
7,210,716 B2 * 5/2007 Mueller ..... E05B 77/06 292/336.3
7,819,440 B2 * 10/2010 Schwickerath ..... E05B 81/06 292/201
8,746,758 B2 * 6/2014 Savant ..... E05B 77/06 292/336.3
9,145,712 B1 * 9/2015 Tien ..... E05B 17/04
2005/0115289 A1 * 6/2005 Talukdar ..... E05B 5/00 70/208
2011/0192201 A1 * 8/2011 Lin ..... E05B 53/00 70/92
2011/0248518 A1 * 10/2011 Tien ..... E05B 13/005 292/336.3
2014/0165669 A1 * 6/2014 Tien ..... E05B 15/02 70/91

* cited by examiner

OUTER OPERATING DEVICE FOR A DOOR LOCK

BACKGROUND OF THE INVENTION

The present invention relates to an outer operating device for a door lock and, more particularly, to an outer operating device that can be used with different latch devices by slight modification.

Door locks have various types according to the conditions, situations, and needs. One type of the door locks, such as a mortise lock, includes a latch device mounted in a space defined between an inner side and an outer side of a door, an outer operating device mounted to the outer side of the door and operably connected to the latch device, and an inner operating device mounted to the inner side of the door and operably connected to the latch device. The inner and outer operating devices can be operated independently to control a latch of the latch device from a latching position to an unlatching position.

Another type of the door locks, such as a panic exit door lock, includes an outer operating device mounted to the outer side of a door, and a latch device of a different type is mounted to the inner side of the door. Such a latch device generally includes an elongated press bar that can be pressed to move a latch of the latch device from the latching position to the unlatching position. Alternatively, the outer operating device can be operated to move the latch from the latching position to the unlatching position.

Since the latch devices of mortise locks and panic exit door locks are different in the installation location and the structure, the manufacturers have to produce two types of outer operating devices for mounting in the space of the door and the inner side of the door, anti the two types of outer operating devices can not share most of the parts.

Thus, a need exists for an outer operating device that can be used in different latch devices by changing a length and a coupling position of a driving member, providing wider applications and reducing the manufacturing costs.

BRIEF SUMMARY OF THE INVENTION

The present invention solves this need and other problems in the field of outer operating devices of door locks by providing an outer operating device including a mounting plate having a through-hole. The mounting plate is adapted to be mounted to an outer side of a door. A casing is fixed to the mounting plate and is aligned with the through-hole. The casing includes a first installation space and a second installation space. A mounting seat is fixed to the mounting plate and is located in the first installation space of the casing. The mounting seat includes a first pivotal end, a second pivotal end, and a stop end. The first pivotal end is located between the stop end and the second pivotal end. The mounting seat further includes an installation space. A cylinder is mounted in the second installation space of the casing. The cylinder includes a lock core and an actuating block coupled to the lock core, wherein the actuating block is pivotable when the lock core is in an unlocked state. A driving wheel is pivotably mounted in the installation space of the mounting seat and located on the first pivotal end of the mounting seat. The driving wheel includes first and second sides and an outer periphery extending between the first and second sides. A stop block and a driving toothed portion are formed on the outer periphery of the driving wheel and are spaced from each other in a circumferential direction about a pivotal axis about which the driving wheel pivots. The driving wheel further includes a track extending from the first side through the second side of the driving wheel. The driving toothed portion of the driving wheel faces the second pivotal end of the mounting seat. The stop block faces the stop end of the mounting seat.

A movable block is slideably received in the track of the driving wheel. The movable block includes a first face and a second face opposite to the first face. The movable block further includes a notch in the second face. The movable block is movable along the track between a joint movement position and a disengagement position. A follower is coupled to the movable block and is jointly movable with the movable block. The follower includes a protrusion extending beyond the mounting seat. When the actuating block of the cylinder pivots to presses against and move the protrusion of the follower, the movable is driven to move between the joint movement position and the disengagement position. A driving member is pivotably mounted in the installation space of the mounting seat and is located on the second pivotal end of the mounting seat. The driving member includes a follower portion and a driving portion. The driving portion includes a distal end distant to the follower portion. The driving member includes a driven toothed portion meshed with the driving toothed portion of the driving wheel. The distal end of the driving member moves between a pressing position and a release position when the driving wheel pivots. The distal end of the driving member is adapted to couple with a latch device mounted to the door. A latch of the latch device is adapted to be in an unlatching position when the driving member is in the pressing position. The latch of the latch device is adapted to be in a latching position when the driving member is in the release position. A lever is pivotably connected to the first pivotal end of the mounting seat. The lever includes a pressing end located on the casing and a movable end located outside of the casing. The lever further includes an axle hole adjacent to the pressing end. The axle hole of the lever is pivotably connected to the first pivotal end of the mounting seat. The pressing end of the lever is aligned with the movable block.

When the driving member is in the release position, the stop block of the driving wheel abuts the stop end of the mounting seat.

When the driving member is in the pressing position, the stop block of the driving wheel is spaced from the stop end of the mounting seat in a circumferential direction about the pivotal axis of the driving wheel.

When the movable block is in the joint movement position, the pressing end of the lever is not aligned with the notch of the movable block.

When the movable block is in the disengagement position, the pressing end of the lever is aligned with the notch of the movable block.

When the movable block is in the joint movement position and when the driving member is in the release position, if the lever is pivoted, the pressing end of the lever presses against the second face of the movable block, causing pivotal movement of the driving wheel to pivot the driving member from the release position to the pressing position, and When the movable block is in the disengagement position and when the driving member is in the release position, if the lever is pivoted, the pressing end of the lever moves into the notch of the movable block, and the driving wheel and the driving member are not moved.

The driving wheel can further include an axle hole extending from the first side through the second side of the driving wheel. The driving member can further include a through-hole between the driven toothed portion and the distal end. The mounting seat can further include a first fixing hole in the first pivotal end, a second fixing hole in the second pivotal end, and a third fixing hole located between the first fixing hole and the second fixing hole. The outer operating device can further include an axle and a pivotal pin. The axle is mounted in the first fixing hole of the mounting seat and is pivotably received in the axle hole of the driving wheel and the axle hole of the lever, permitting the driving wheel and the lever to pivot about a pivotal axis defined by the axle. The pivotal pin is selectively mounted in one of the second fixing hole and the third fixing hole. The pivotal pin is pivotably received in the through-hole of the driving member. The pivotal pin defines the pivotal axis of the driving member. When the pivotal pin is mounted in the second fixing hole, the latch device is coupled to the driving member is adapted to be mounted to an inner side of the door. When the pivotal pin is mounted in the third fixing hole, the latch device coupled to the driving member is adapted to be mounted in a space between the inner and outer sides of the door.

The lever can further include a limiting slot in the movable end. The limiting slot has an end. The outer operating device can further include a coupling seat fixed to the mounting plate and a first fixing pin extending through the limiting slot of the lever and inserted into the coupling seat. When the driving member is in the pressing position, the first fixing pin abuts the end of the limiting slot of the lever.

The coupling seat can further include an extension having a chamber. The first fixing pin extends into the extension of the coupling seat and is spaced from the chamber. The outer operating device can further include a first connecting member fixed to the lever and located adjacent to the limiting slot, a tension spring mounted in the chamber of the coupling seat, with the tension spring including a first end attached to the first connecting member and a second end received in the chamber, and a second fixing pin extending through the extension into the chamber of the coupling seat. The second end of the tension spring is attached to the second fixing pin. When the lever pivots and causes pivotal movement of the driving member from the release position to the pressing position, the first connecting member pulls the tension spring to provide a returning force.

The driving wheel can further include a groove in the bottom face of the track. The movable block can further include a lower face extending between the first and second faces of the movable block. The lower face faces the bottom face of the track. The movable block can further include first and second positioning grooves defined in the lower face and spaced from each other. The outer operating device can further include a positioning member received in the groove of the driving wheel and a compression spring received in the groove of the driving wheel and biasing the positioning member. When the movable block is in the joint movement position, the first positioning groove of the movable block is aligned with the groove of the driving wheel, and the compression spring biases the positioning member to engage with the first positioning groove of the movable block. When the movable block is in the disengagement position, the second positioning groove of the movable block is aligned with the groove of the driving wheel, and the compression spring biases the positioning member to engage with the second positioning groove of the movable block.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
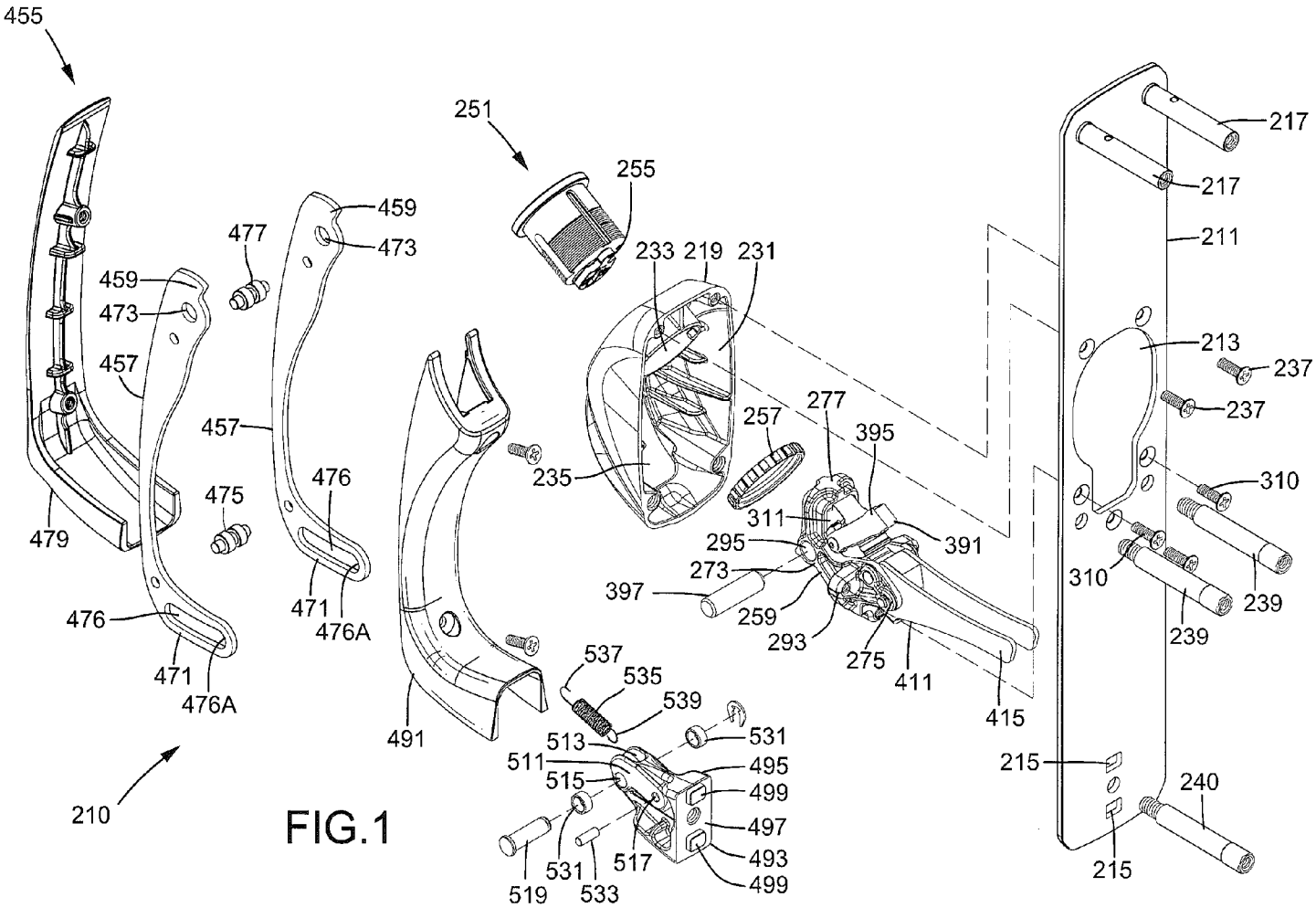
FIG. 1 is an exploded, perspective view of an outer operating device for a door lock according to the present invention, with the outer operating device adapted to be assembled to be of a first type.
Figure 2:
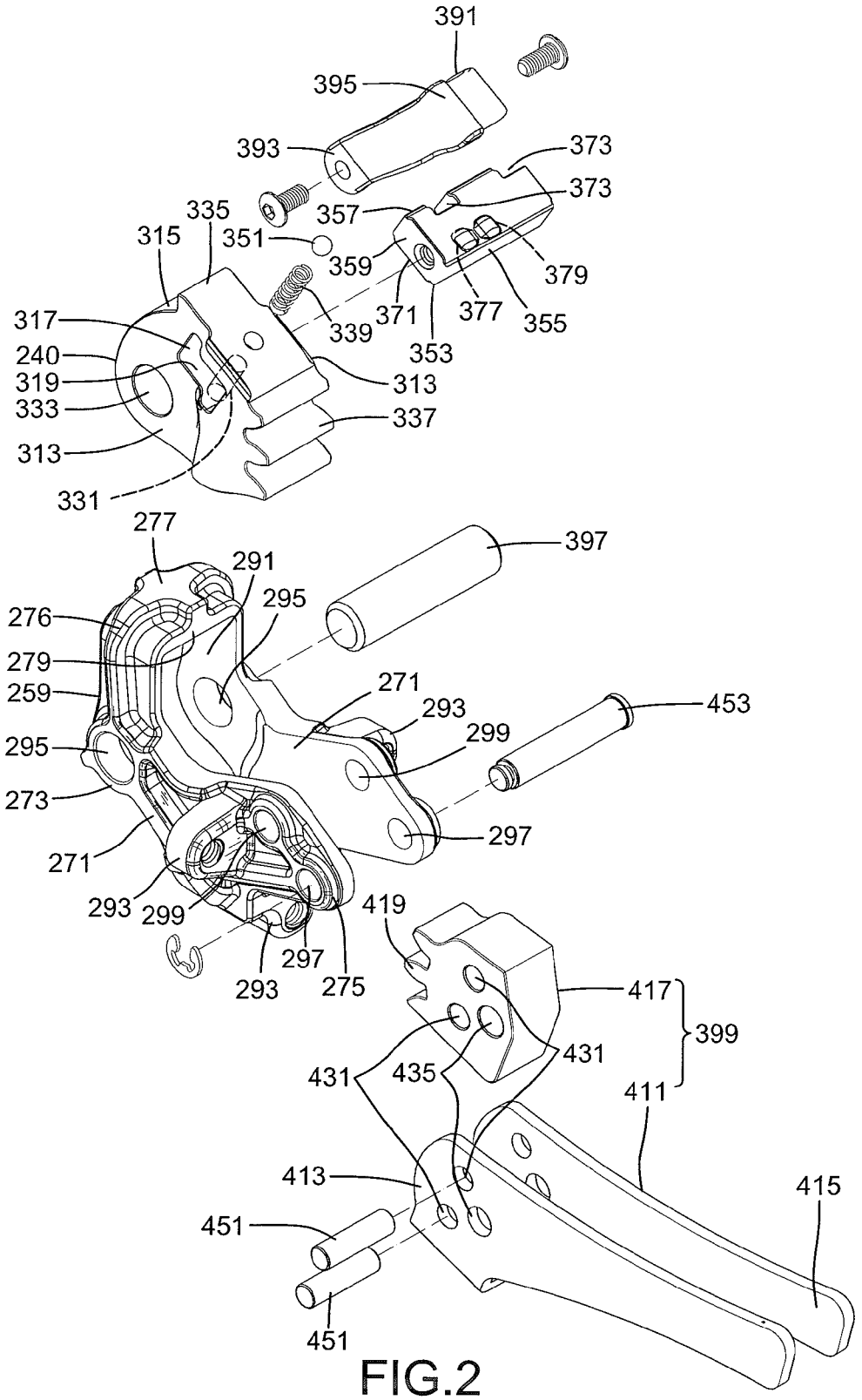
FIG. 2 is an exploded, perspective view of a portion of the outer operating device of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms “first”, “second”, “third”, “lower”, “upper”, “bottom”, “side”, “end”, “portion”, “spacing”, “length”, and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 3:
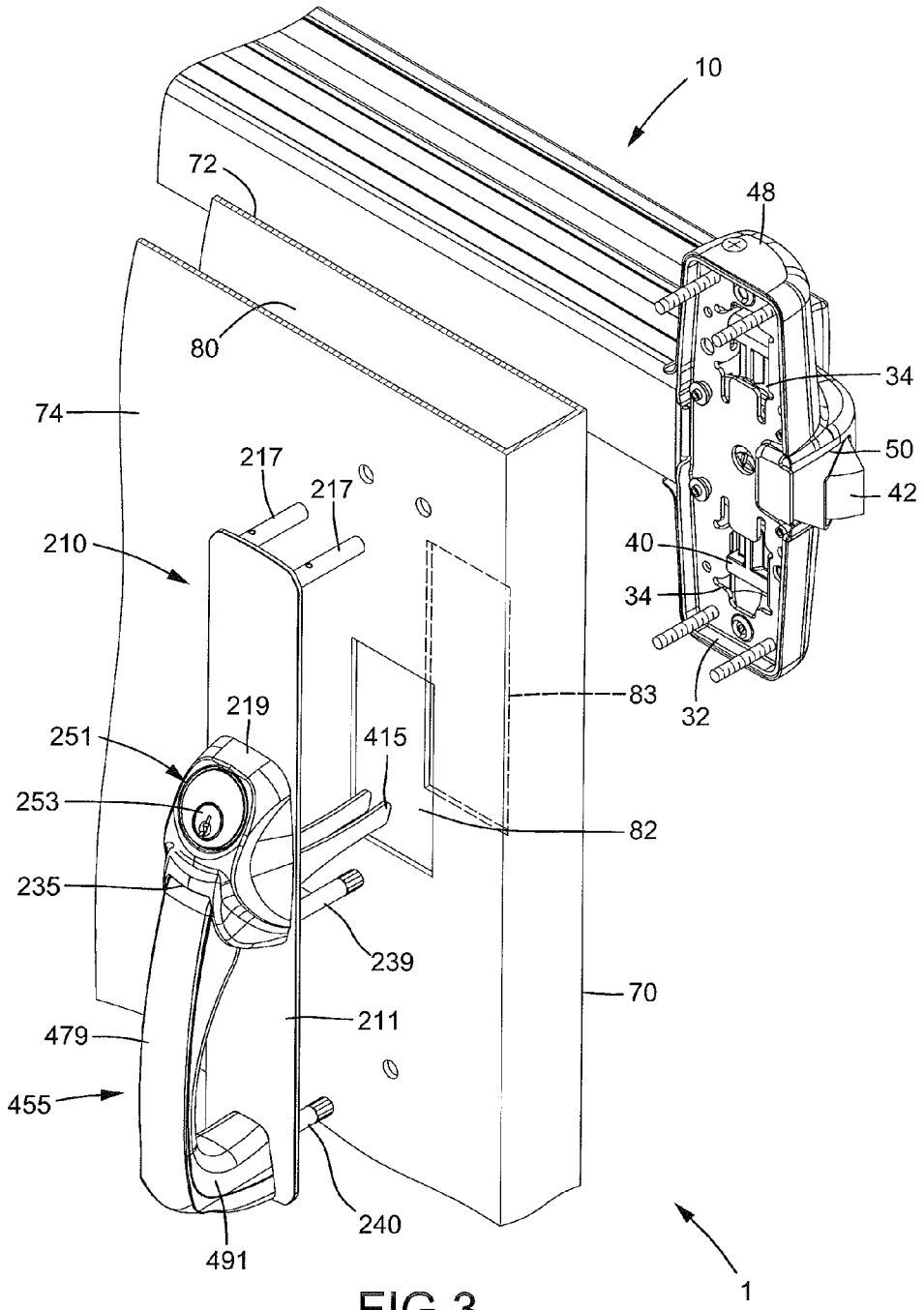
FIG. 3 is an exploded, perspective view of a door and a door lock including a latch device and utilizing the outer operating device of FIG. 1.
Figure 16:
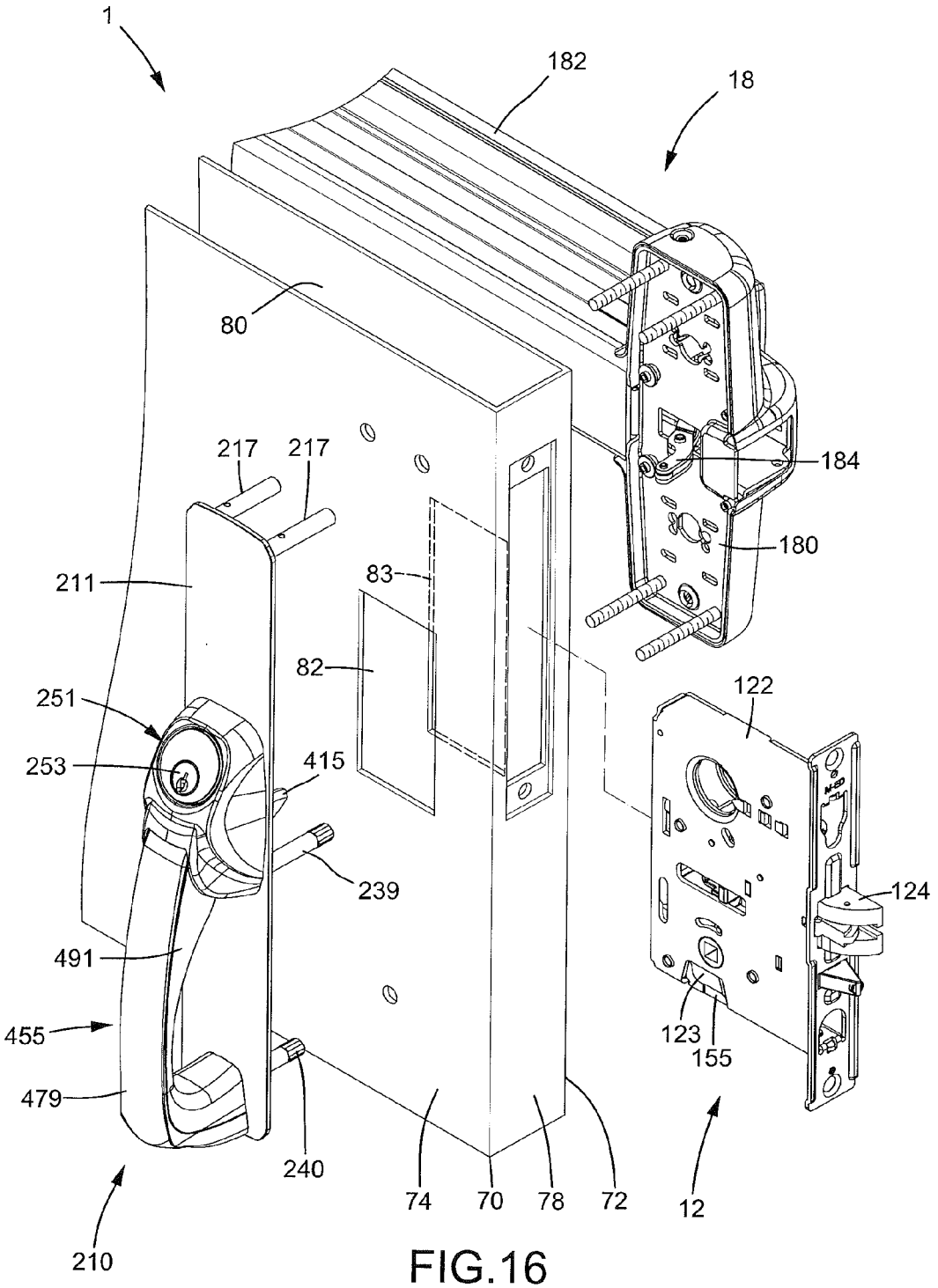
FIG. 16 is an exploded, perspective view of a door and a door lock including a latch device and utilizing the outer operating device of FIG. 15.
Figure 17:
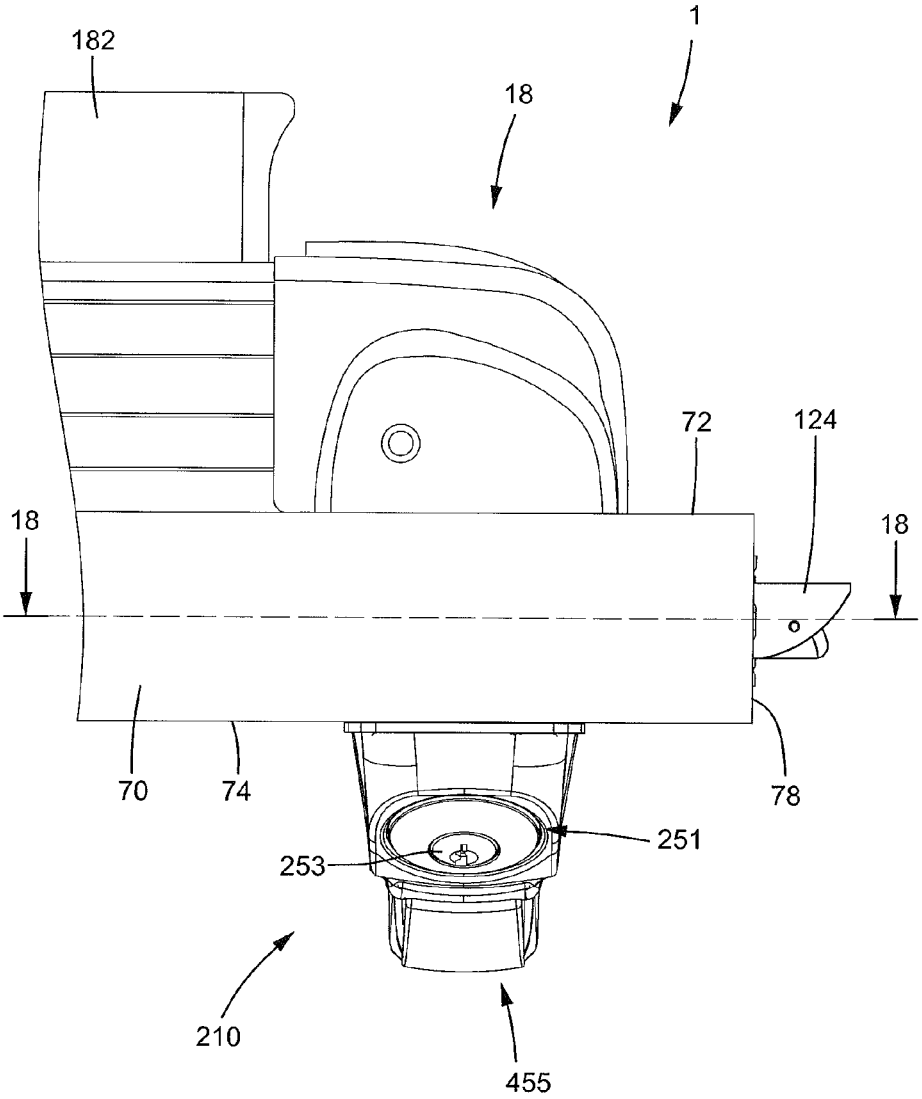
FIG. 17 is a top view of the door and the door lock after assembly.

An outer operating device according to the present invention is shown in the drawings and generally designated 210. Outer operating device 210 can be assembled to be of a first type or a second type. Outer operating device 210 of the first type can be used to work with a latch device 10 (FIG. 3) mounted in an inner side 72 of a door 70. Outer operating device 210 of the second type can be used to work with a latch device 12 (FIG. 16) mounted to a space 80 in door 70.

With reference to FIGS. 1-14, outer operating device 210 of the first type includes a mounting plate 211 having a through-hole 213 and two coupling holes 215. Two mounting posts 217 are fixed to a side of mounting plate 211. Each mounting post 217 includes an end having a screw hole. Through-hole 213 is located between mounting posts 217 and coupling holes 215. Outer operating device 210 further includes a casing 219 fixed to mounting plate 211. Casing 219 includes a first installation chamber 231 and a second installation chamber 233 defined in an inner wall of first installation chamber 231. Casing 219 further includes a through-slot 235 extending from an outer face of casing 219 to first installation chamber 231. Two first screws 237 and two first engagement rods 239 extend through mounting plate 211 into casing 219 to fix casing 219 to mounting plate 211, with first installation chamber 231 aligned with through-hole 213. Each engagement rod 239 has a screw hole in an end thereof.

Outer operating device 210 of the first type further includes a mounting seat 259 having two substantially L-shaped sidewalls 271 and a connecting wall 277 extending between sidewalls 271. Connecting wall 277 includes a stop face 279. Each sidewall 271 includes a first pivotal end 273, a second pivotal end 275, and a stop end 276 adjacent to connecting wall 277. First pivotal end 273 is located between stop end 276 and second pivotal end 275. An installation space 291 is defined by sidewalls 271 and connecting wall 277. Mounting seat 259 further includes two aligned first fixing holes 295, two aligned second fixing holes 297, and two aligned third fixing holes 299. Each first fixing hole 295, each second fixing hole 297, and each third fixing hole 299 extend from an outer face through an inner face of one of sidewalls 271. Each first fixing hole 295 is located in first pivotal end 273. Each of second fixing holes 297 and third fixing holes 299 is located in second pivotal end 275. Each third fixing hole 299 is located between one of first fixing holes 295 and one of second fixing holes 297. Mounting seat 259 further includes three lugs 293.

Three second screws 310 extend through mounting plate 211 into lugs 293 of mounting seat 259. Thus, mounting seat 259 is fixed to mounting plate 211 and is located in first installation chamber 231 of casing 219. Furthermore, second pivotal end 275 passes through through-hole 213 of mounting plate 211 to an inner side of mounting plate 211.

Outer operating device 210 of the first type further includes a driving wheel 311 pivotably mounted in installation space 291 of mounting seat 259. Driving wheel 311 includes first and second sides 313 and an outer periphery 315 extending between first and second sides 313. Formed on outer periphery 315 of driving wheel 311 are a stop block 335 and a driving toothed portion 337 spaced from stop block 335 in a circumferential direction about a pivotal axis of driving wheel 311. Driving toothed portion 337 includes a plurality of teeth. Driving wheel 311 further includes an axle hole 333 and a track 317. Each of axle hole 333 and track 317 extends from first side 313 through second side 313. Track 317 is located between stop block 335 and driving toothed portion 337. Track 317 includes a bottom face 319 having a groove 331.

Axle hole 333 of driving wheel 311 is aligned with first fixing holes 295 of mounting seat 259. An axle 397 includes two ends respectively fixed in first fixing holes 295. Axle 397 is pivotably received in axle hole 333. Driving wheel 311 is pivotable about a pivotal axis defined by axle 397. Furthermore, stop block 335 of driving wheel 311 faces stop end 276 of mounting seat 259, and driving toothed portion 337 faces second pivotal end 275.

Outer operating device 210 of the first type further includes a movable block 353 slideably engaged with track 317 and a follower 391 coupled to movable block 353. Movable block 353 includes a first face 355 and a second face 357 opposite to first face 355. Movable block 353 further includes two end faces opposite to each other and extending between first and second faces 355 and 357. Movable block 353 further includes a lower face 371 extending between first and second faces 355 and 357 and between end faces 359. Movable block 353 further includes two notches 373 defined in second face 357 and spaced from each other. Movable block 353 further includes first and second positioning grooves 377 and 379 defined in lower face 371 and spaced from each other.

Figure 12:
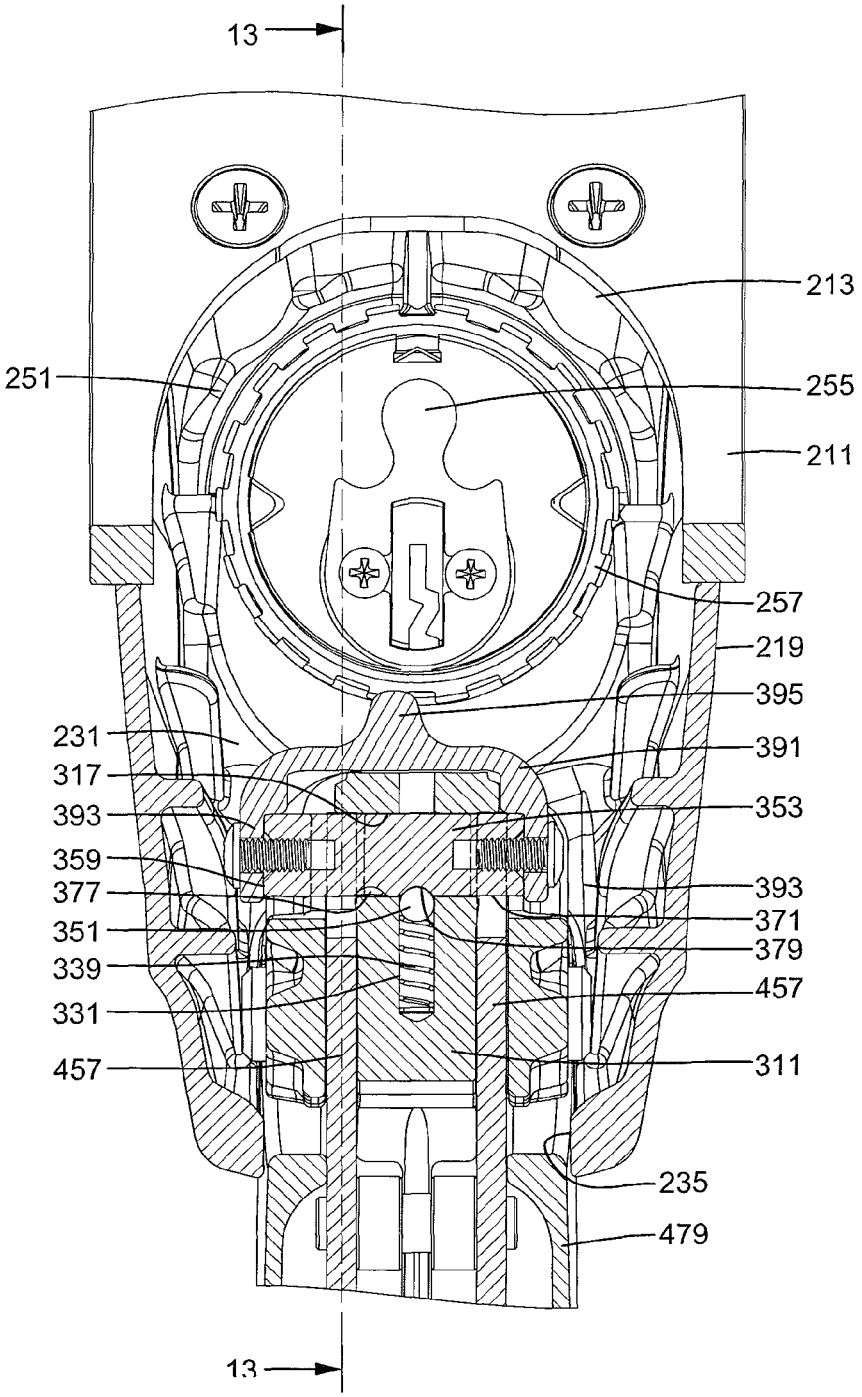
FIG. 12 is a view similar to FIG. 11 with the actuating block of the cylinder further pivoted to move a movable block to a disengagement position.
Figure 13:
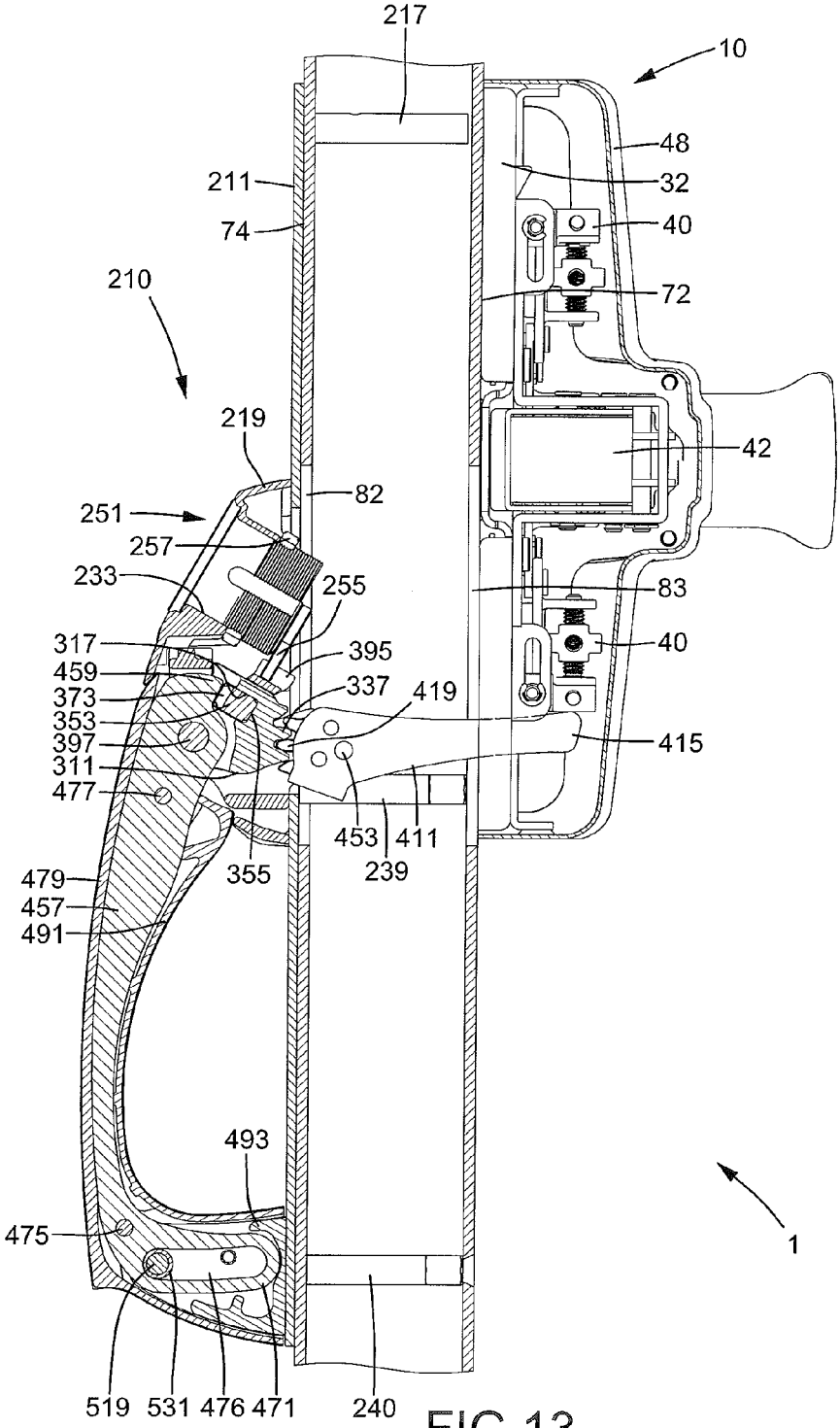
FIG. 13 is a cross sectional view taken along section line 13-13 of FIG. 12.
Figure 14:
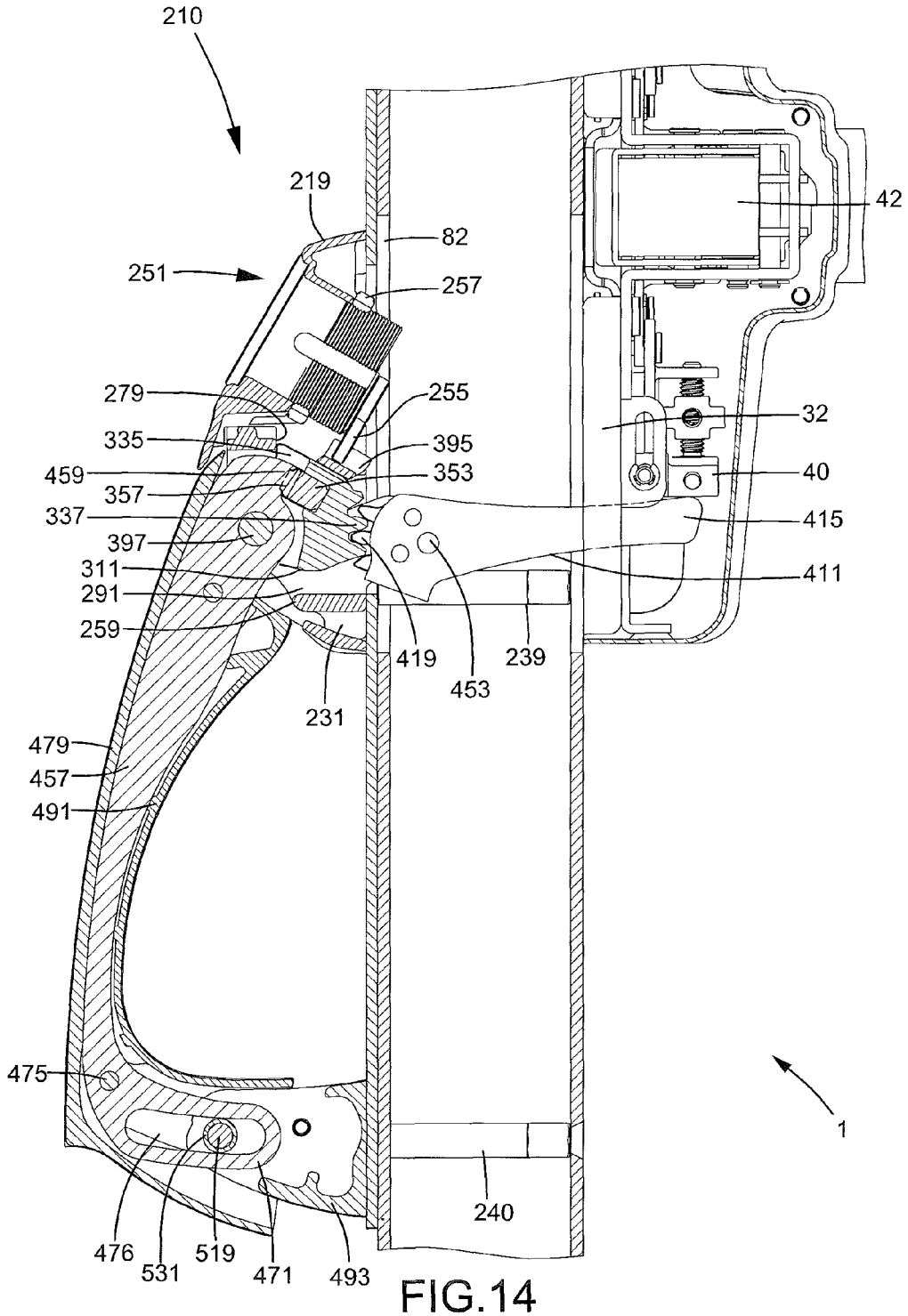
FIG. 14 is a view similar to FIG. 13 with a handle pulled and with an actuating member remained still.
Figure 15:
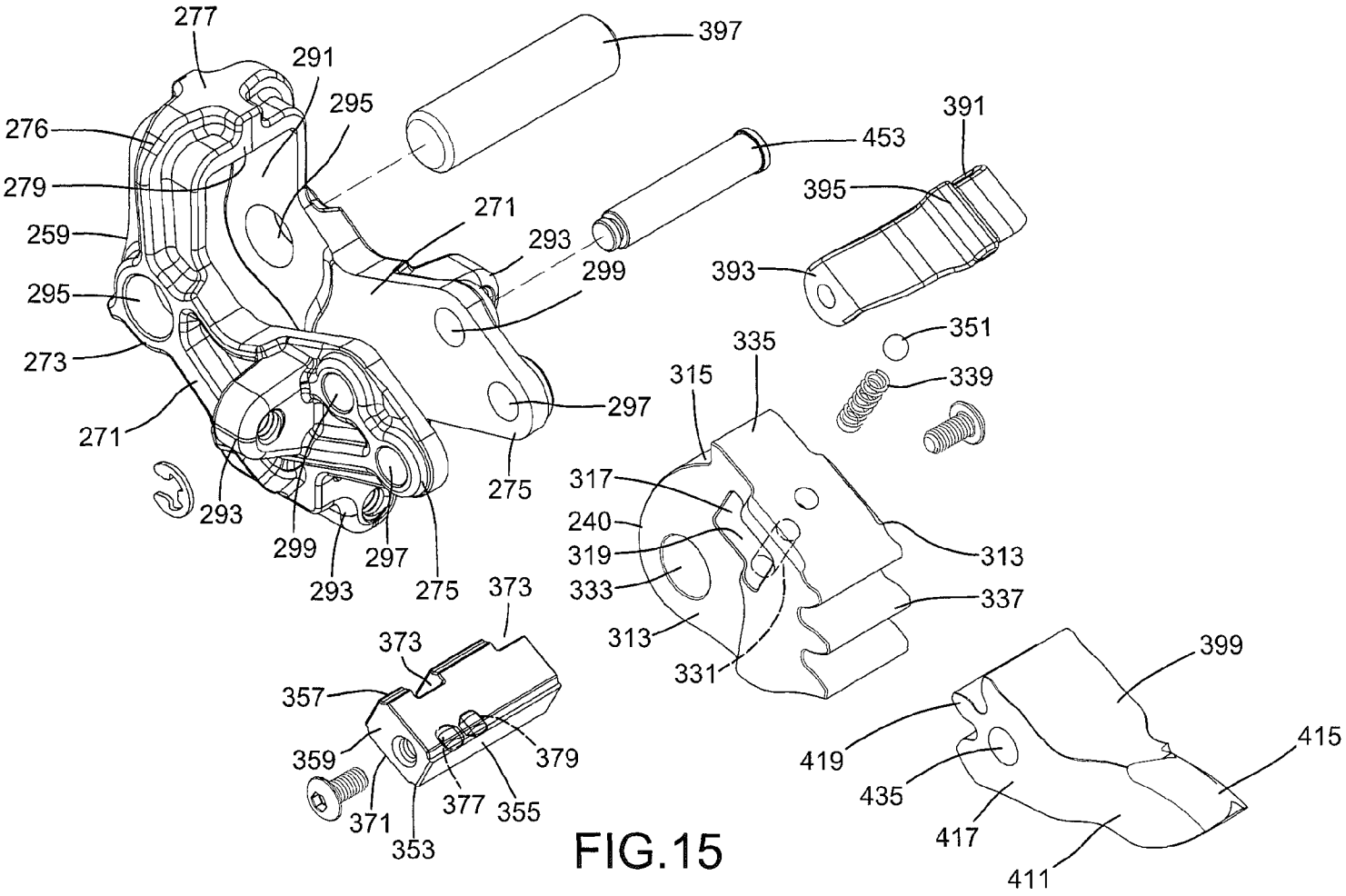
FIG. 15 is an exploded, perspective view of a portion of the outer operating device to be assembled to be of a second type.

Lower face 371 of movable block 353 faces bottom face 319 of track 317 of driving wheel 311. Second face 357 and each notch 373 face stop block 335. Movable block 353 is retrained by track 317 and is pivotable about the pivotal axis defined by axle 397 between a joint movement position (FIGS. 5-7) and a disengagement position (FIGS. 12-14). When movable block 353 is in the joint movement position, first positioning groove 377 of movable block 353 is aligned with groove 331 of track 317 of driving wheel 311.

Follower 391 includes two engagement portions 393 corresponding to end faces 359 of movable block 353. Follower 391 further includes a protrusion 395 between engagement portions 393. Follower 391 extends across movable block 353, and each engagement portion 393 abuts a corresponding end face 359. Two screws extend through engagement portions 393 into screw holes in end faces 359 of movable block 353. Thus, follower 391 and movable block 353 move jointly between the joint movement position and the disengagement position. Furthermore, a compression spring 339 and a positioning member 351 are received in groove 331 of track 317 of driving wheel 311. Compression spring 339 biases positioning member 351 towards movable block 353 such that positioning member 351 selectively engages with one of first and second positioning grooves 377 and 379 to position movable block 353.

Outer operating device 210 of the first type further includes a driving member 399 pivotably mounted in installation space 291 of mounting seat 259. Driving member 399 includes a follower portion 417 and a driving portion 411. Driving portion 411 includes an engagement end 413 and a distal end 415 distant to follower portion 417. Follower portion 417 includes a driven toothed portion 419 having a plurality of teeth. Follower portion 417 is received in engagement end 413 of driving portion 411. Each of driving portion 411 and follower portion 417 includes a through-hole 435 and two fixing holes 431. Two fixing pins 451 extend through fixing holes 431 of driving portion 411 and follower portion 417. Thus, follower portion 417 can not move relative to driving portion 411.

Figure 5:
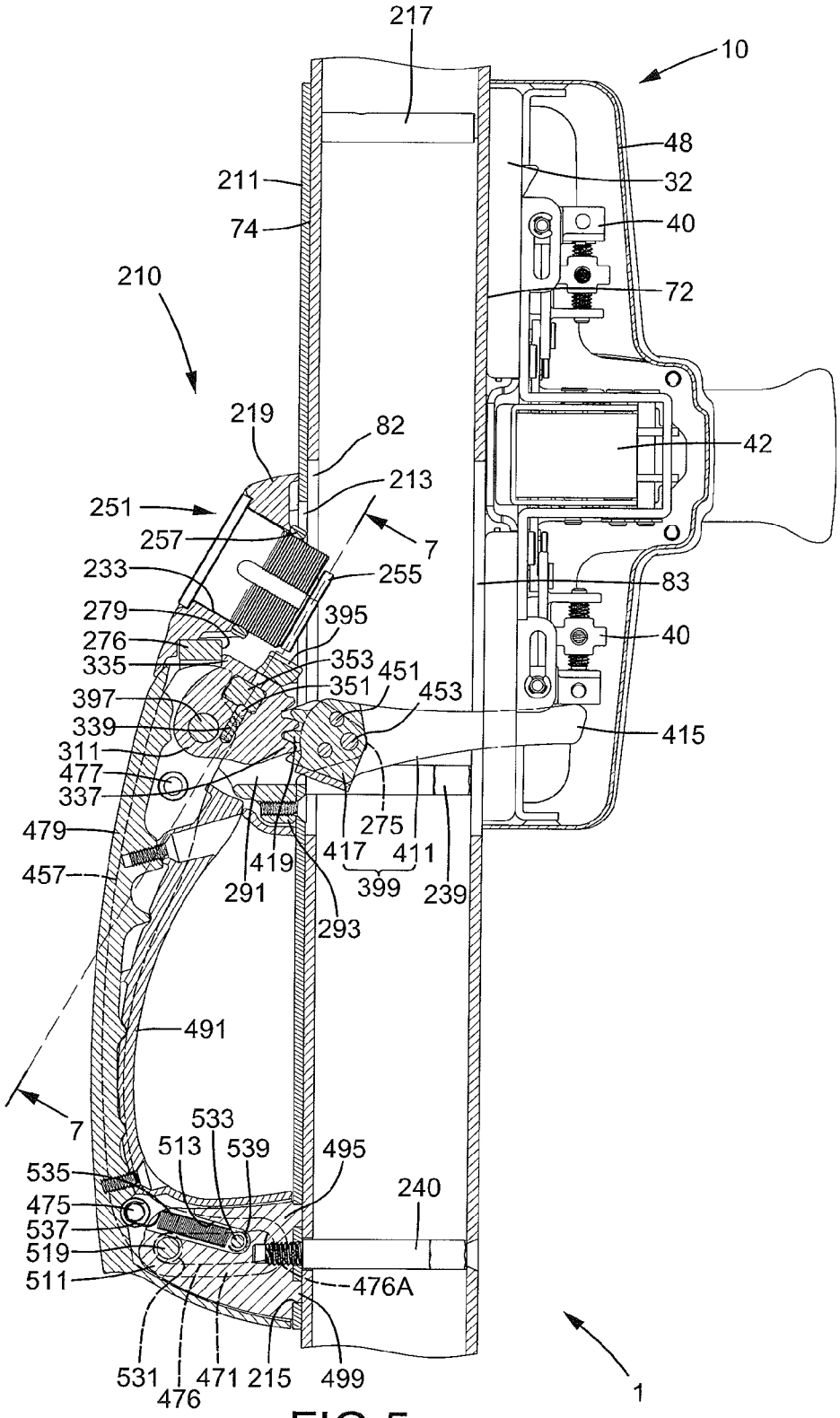
FIG. 5 is a cross sectional view taken along section line 5-5 of FIG. 4.
Figure 6:
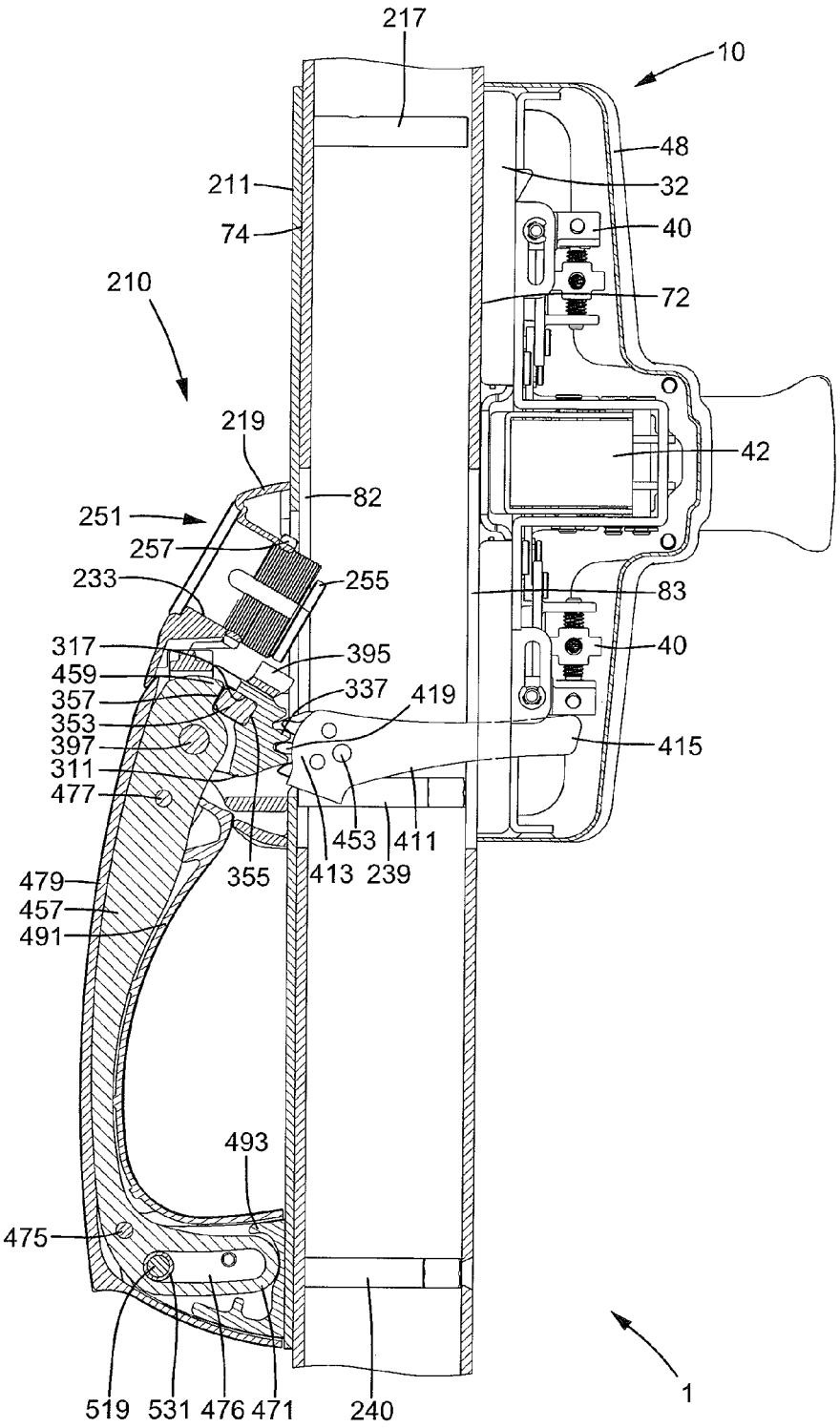
FIG. 6 is a cross sectional view taken along section line 6-6 of FIG. 4.

Through-holes 435 of driving member 399 are aligned with second fixing holes 297 of mounting seat 259. A pivotal pin 453 includes two ends mounted in second fixing holes 297 of mounting seat 259 and is pivotably received in through-holes 435 of driving member 399. Furthermore, driven toothed portion 419 of driving member 399 meshes with driving toothed portion 337 of driving wheel 311. Thus, when driving wheel 311 pivots, driving member 399 pivots about a pivotal axis defined by pivotal pin 453 between a pressing position in which distal end 415 is in an upper position (FIGS. 9-10) and a release position in which distal end 415 is in a lower position (FIGS. 5-6).

Outer operating device 210 of the first type further includes a handle 455 pivotably connected to mounting seat 259. Handle 455 includes two levers 457 having the same shape in the forms shown in FIGS. 1-21. Each lever 457 includes a pressing end 459 and a movable end 471. Each lever 457 further includes an axle hole 473 adjacent to pressing end 459 and a limiting slot 476 in movable end 471. Limiting slot 476 of each lever 457 includes an end 476A adjacent to a distal portion of movable end 471. First and second connecting members 475 and 477 are mounted between two levers 457. First and second connecting members 475 and 477 have the same shape and size in the forms shown in FIGS. 1-21. Thus, levers 457 are kept spaced from and parallel to each other. First connecting member 475 is located adjacent to the other end of a corresponding limiting slot 476. Second connecting member 477 is located adjacent to each axial hole 473. Furthermore, first connecting member 475 is located between second connecting member 477 and each limiting slot 476.

Pressing end 459 of each lever 457 is received between one of first and second sides 313 of driving wheel 311 and a corresponding sidewall 271 of mounting seat 259. Axle 397 is pivotably received in axle holes 473 of levers 457. The remaining portion of each lever 457 extends through through-slot 235 of casing 219 to the outside of casing 219. Thus, levers 457 can pivot about a pivotal axis defined by axle 397. Pressing end 459 of each lever 457 faces second face 357 of movable block 353. Handle 455 further includes first and second handle casing 479 and 491 that couple with each other to form a handle casing receiving levers 457.

Outer operating device 210 of the first type further includes a coupling seat 493 fixed to mounting plate 211 and located below casing 219. Coupling seat 493 includes a body 495 having an end face 497 with two insertion blocks 499. Coupling seat 493 further includes an extension 511 extending from body 495. Extension 511 includes a chamber 513. Extension 511 further includes first and second holes 515 and 517, with each of first and second holes 515 and 517 extending along an axis parallel to the pivotal axis defined by axle 397. First and second holes 515 and 517 are spaced from each other. Second hole 517 intersects with chamber 513.

End face 497 of coupling seat 493 abuts mounting plate 211. Each insertion block 499 of coupling seat 493 engages with one of coupling holes 215 of mounting plate 211. A second engagement rod 240 includes an end extending through mounting plate 211 into body 495 of coupling seat 493, fixing coupling seat 493 to mounting plate 211. A screw hole is defined in the other end of second engagement rod 240.

A first fixing pin 519 is mounted in first hole 515 of coupling seat 493. A cap 531 is mounted to each of two ends of first fixing pin 519 located outside of extension 511 of coupling seat 493. Each cap 531 is received in limiting slot 476 of one of levers 457. Thus, when handle 455 is pulled, each lever 457 pivots until end 476A of each limiting slot 476 abuts an outer periphery of a corresponding cap 531, preventing damage to the internal structure of outer operating device 210 resulting from excessive pivotal movement of handle 455. A second fixing pin 533 is received in second hole 517. A tension spring 535 is received in chamber 513 of coupling seat 493. Tension spring 535 includes a first end 537 attached to first connecting member 475 and a second end 539 located in chamber 513 and attached to second fixing pin 533. Thus, when handle 455 pivots, first end 537 of tension spring 535 is pulled, providing a returning force for returning handle 455.

Outer operating device 210 of the first type further includes a cylinder 251 mounted in second installation chamber 233 of casing 219. Cylinder 251 includes a lock core 253 rotatably received in a cylinder body thereof. Cylinder 251 further includes an actuating block 255 located outside of the cylinder body and fixed to lock core 253, allowing joint rotatable movement of actuating block 255 and lock core 253. A locking ring 257 is threadedly engaged with a threaded portion on an outer periphery of the cylinder body. Locking ring 257 abuts casing 219. A flange is formed on an end of the cylinder body and is received in an outer side of casing 219. Thus, cylinder 251 is fixed in second installation chamber 233.

With reference to FIGS. 1-14, outer operating device 210 of the first type further is mounted to an outer side 74 of door 70. Latch device 10 is mounted to an inner side 72 of door 70. A door lock 1 is formed by latch device 10 and outer operating device 210 of the first type. Door 70 includes space 80 between inner and outer sides 72 and 74. Door 70 further includes a first opening 82 defined in outer side 74 and intercommunicated with space 80. Door 70 further includes a second opening 83 defined in inner side 72 and intercommunicated with space 80. Mounting plate 211 abuts outer side 74 of door 70. Distal end 415 of driving member 399 passes through first and second openings 82 and 83 to a position beyond inner side 72. Mounting posts 217, first engagement rods 239, and second engagement rods 240 are received in space 80 of door 70.

Latch device 10 can be of any desired form as conventional including, but not limited to, of a commercially available type. Latch device 10 shown in FIGS. 1-14 includes a base 32 fixed to inner side 72 of door 70 and having two slots 34. A slide 40 is slideably received in each slot 34. Latch device 10 further includes a pull rod 44 and two link 46. Pull rod 44 is movable relative to base 32 along an axis parallel to the pivotal axis defined by axle 397. Each link 46 is pivotably mounted between pull rod 44 and one of slides 40. Each link 46 has an end pivotably connected to base 32. Latch device 10 further includes a latch 42 pivotably connected to pull rod 44 and base 32. When pull rod 44 moves along the axis, each link 46 pivots relative to base 32 such that each slide 40 moves towards or away from pull rod 44, moving latch 42 between a latching position (FIG. 4) and an unlatching position (FIG. 8).

Base 32 of latch device 10 abuts inner side 72 of door 70. Each mounting post 217 of outer operating device 210 is aligned with one of first engagement rods 239. Screws extend through base 32 of latch device 10 into the screw holes in mounting posts 217 and the screw holes in first engagement rods 239. Thus, outer operating device 210 is fixed to outer side 74 of door 70, and latch device 10 is fixed to inner side 72 of door 70. A casing 48 covers latch device 10 and includes a notch 50 through which latch 42 extends. Furthermore, distal end 415 of driving member 399 of outer operating device 210 extends through a lower one of slots 34 of base 32 and abuts a bottom of one of slides 40 (FIGS. 5 and 6).

Now that the basic construction of outer operating device 210 of the first type has been explained, the operation and some of the advantages of outer operating device 210 can be set forth and appreciated. In particular, for the sake of explanation, it will be assumed that latch 42 of latch device 10 is in the latching position (FIG. 4), such that driving member 399 of outer operating device 210 of the first type is in the release position, and stop block 335 of driving wheel 31 abuts stop face 279 of mounting seat 259. It is further assumed that movable block 353 of outer operating device 210 of the first type is in the joint movement position (FIGS. 5-7), compression spring 339 biases positioning member 351 to engage with first positioning groove 377 of movable block 353

Figure 7:
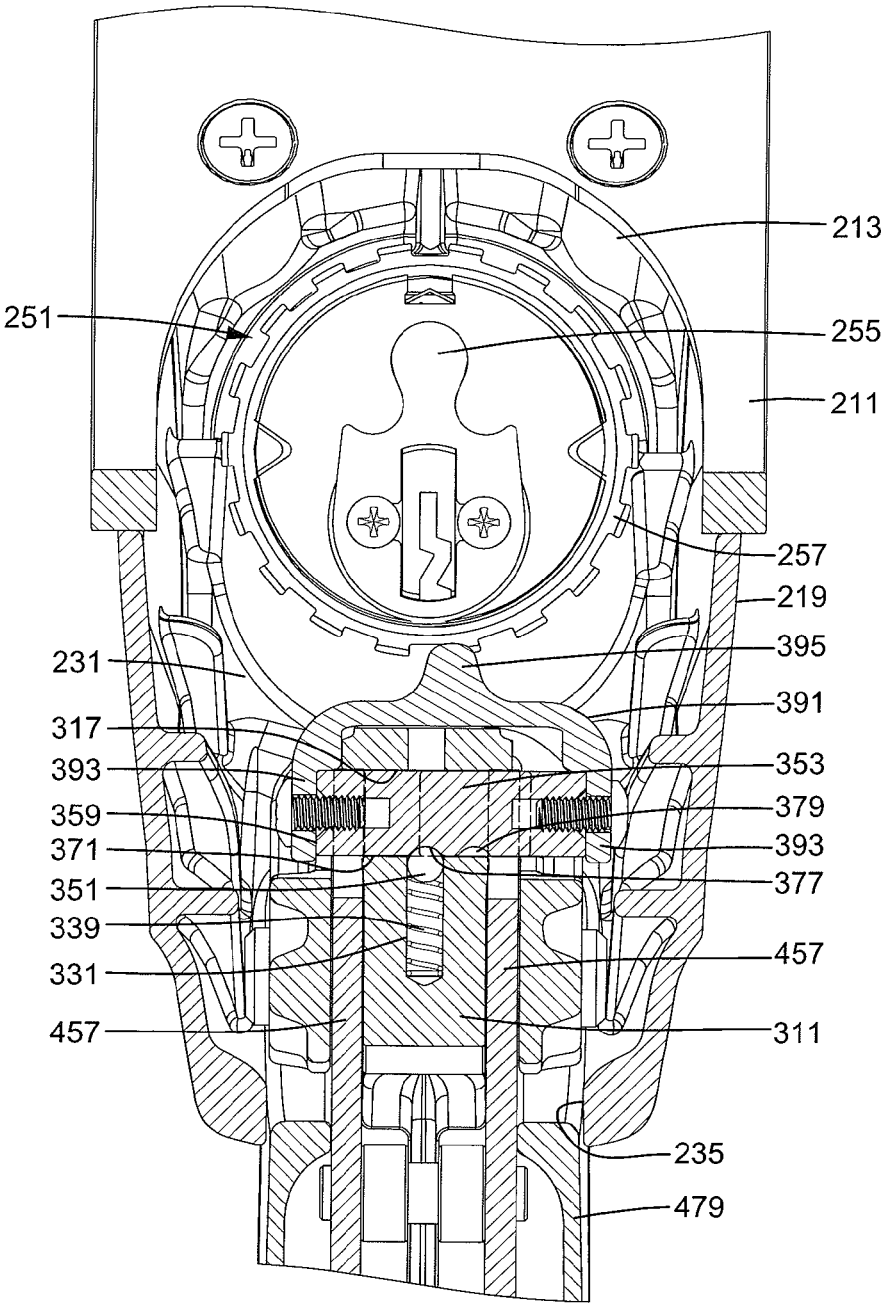
FIG. 7 is a cross sectional view taken along section line 7-7 of FIG. 5.
Figure 8:
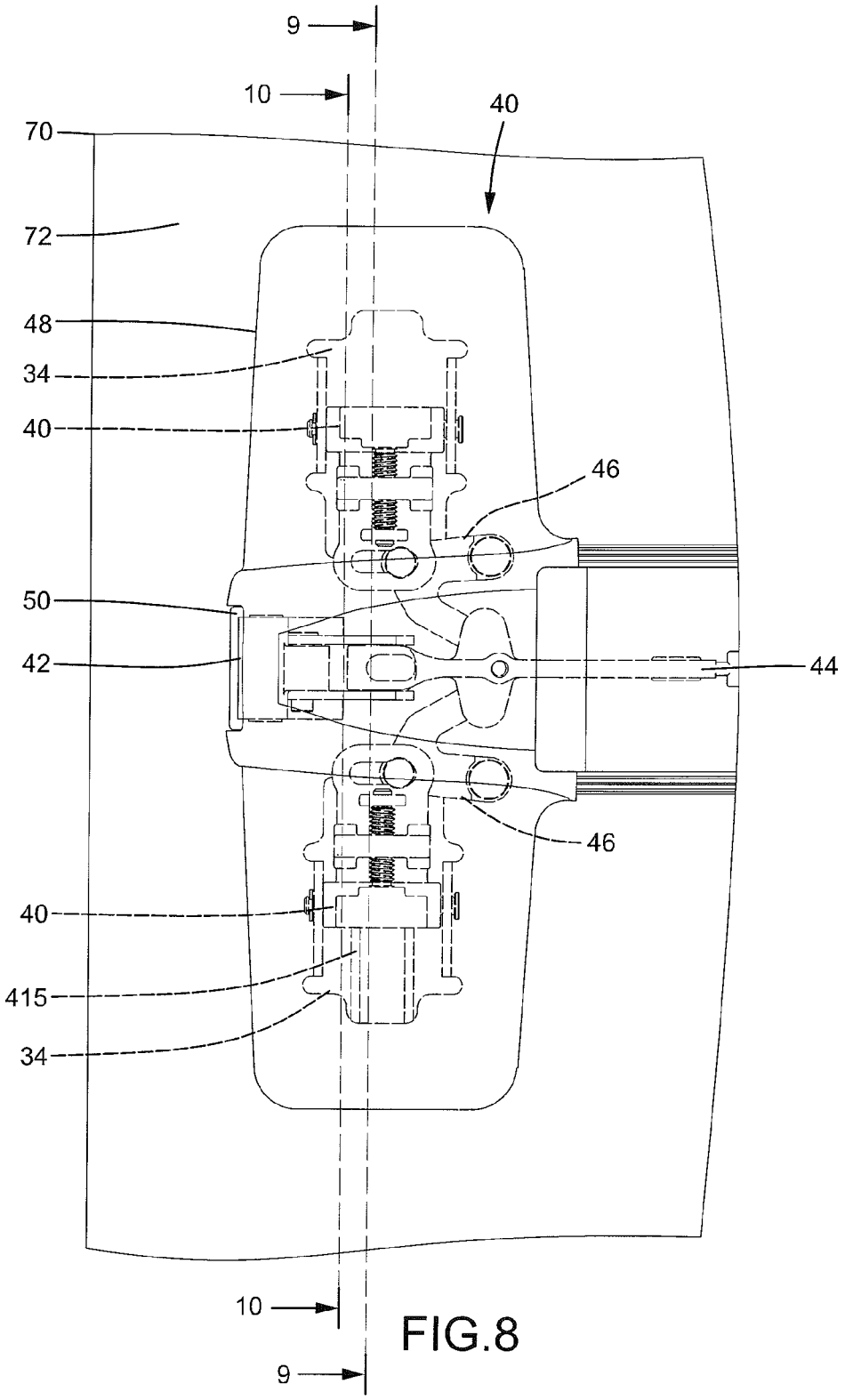
FIG. 8 is a view similar to FIG. 4 with a latch moved to a retracted position.

(FIGS. 5 and 7). Thus, movable block 353 is positioned in the joint movement position. Furthermore, pressing end 459 of each lever 457 is misaligned with a corresponding notch 373 of movable block 353.

Figure 9:
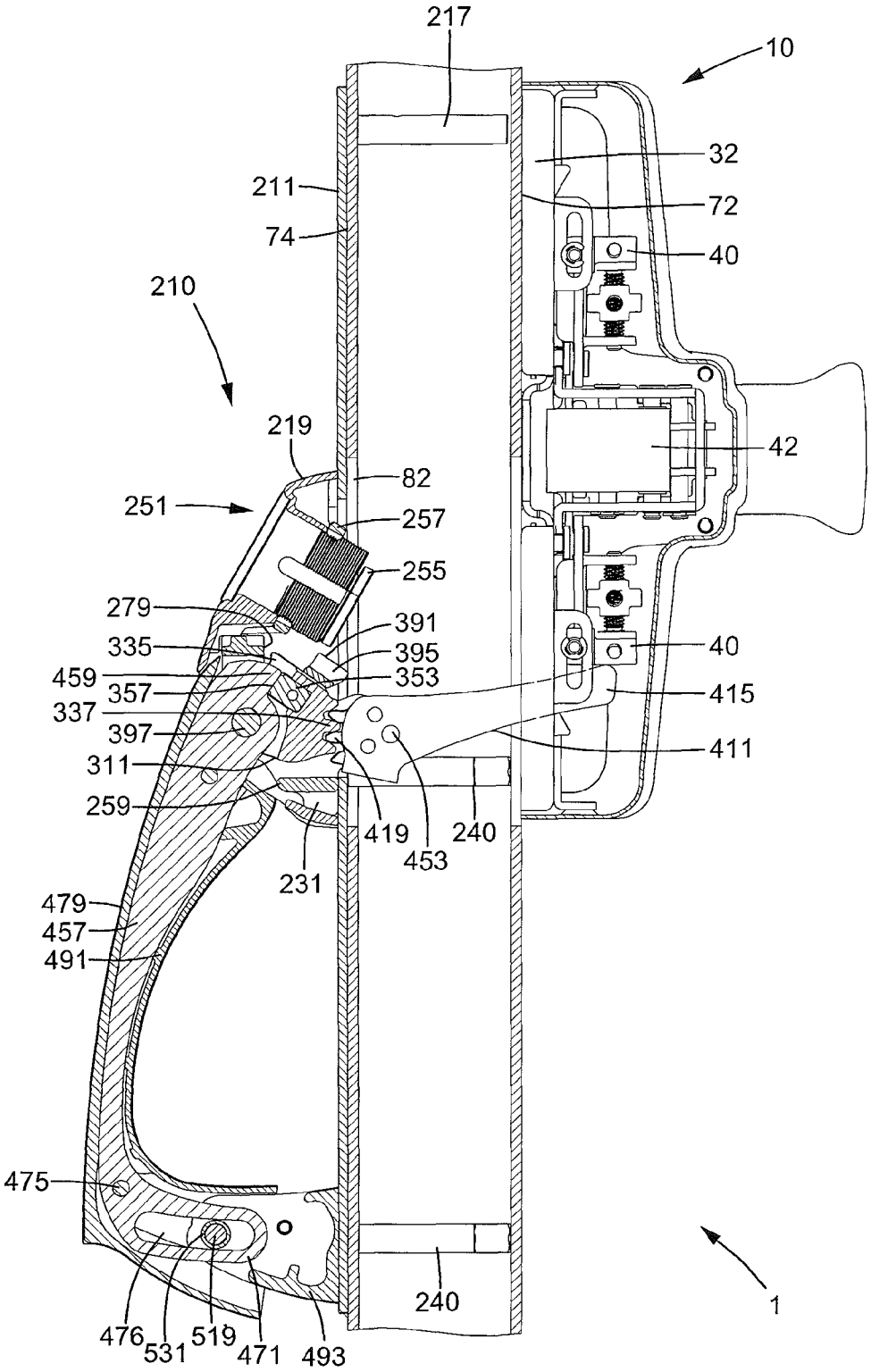
FIG. 9 is a cross sectional view taken along section line 9-9 of FIG. 8.
Figure 10:
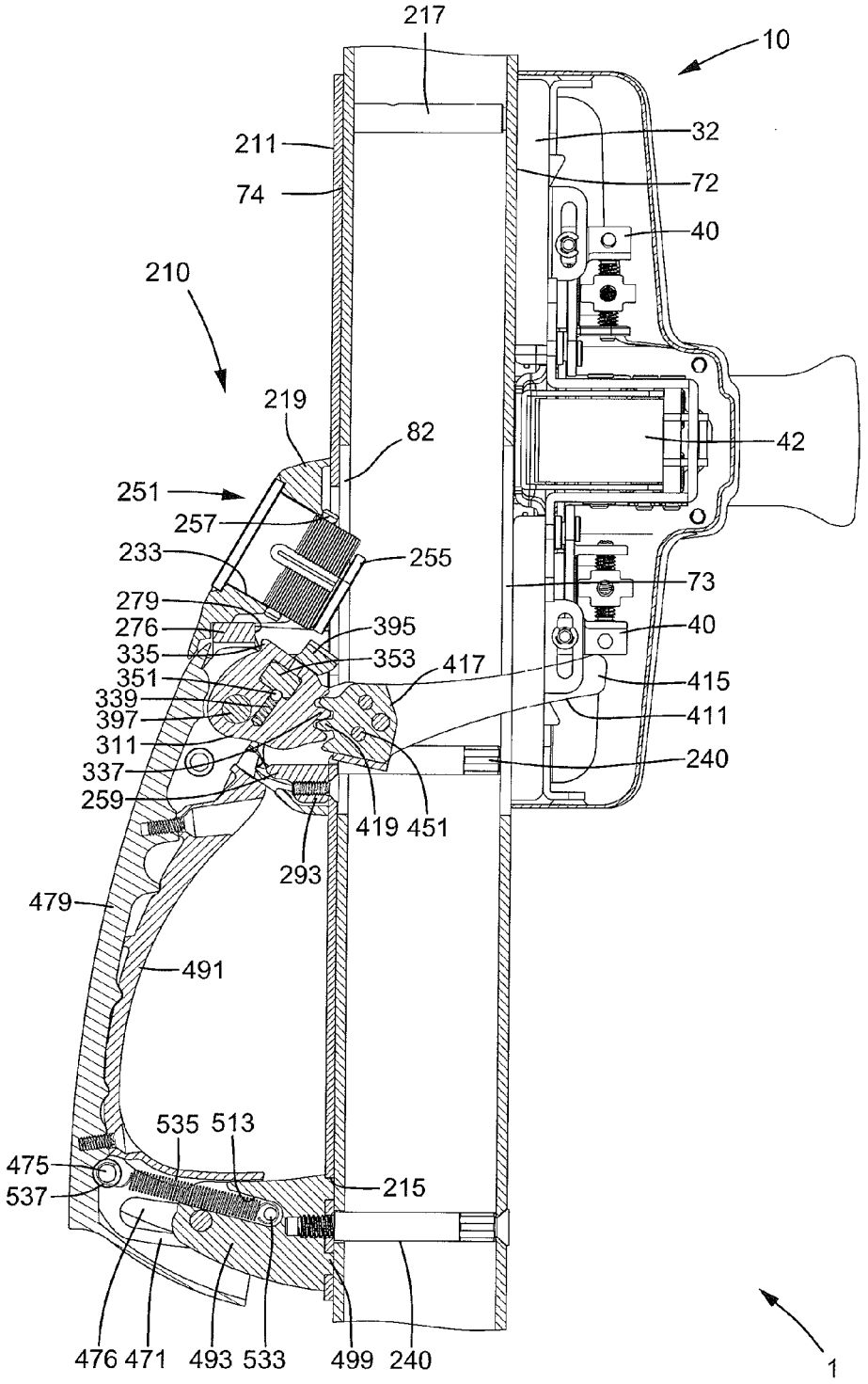
FIG. 10 is a cross sectional view taken along section line 10-10 of FIG. 8.
Figure 11:
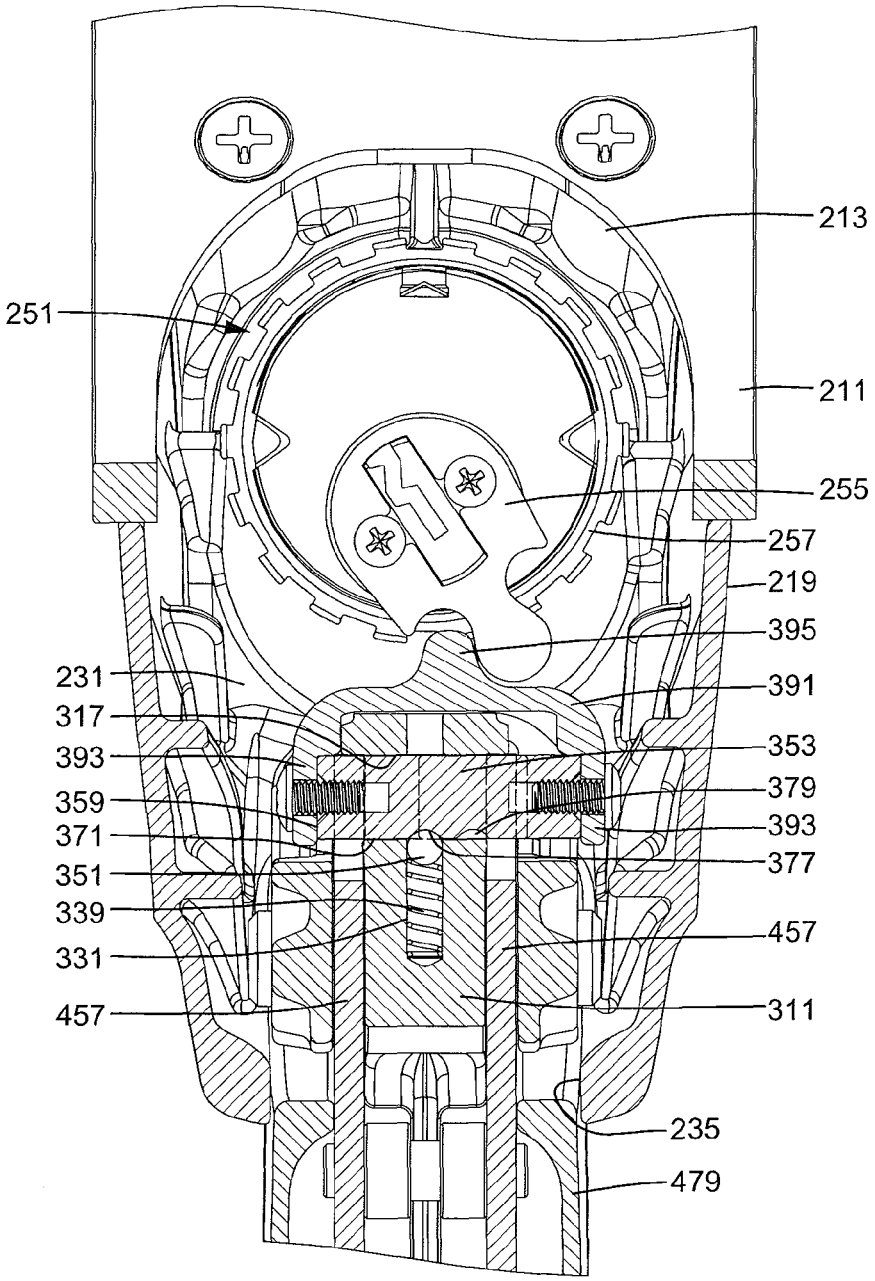
FIG. 11 is a view similar to FIG. 7 with an actuating block of a cylinder pivoted to a position abutting against a protrusion of a follower.

In a case that handle 455 is pulled away from outer side 74 of door 70, pivotal movement of each lever 457 of handle 455 causes each movable end 471 to move away from mounting plate 211. Thus, first connecting member 475 pulls tension spring 535 to provide the returning force for handle 455. Furthermore, pressing end 459 of each lever 457 presses against second face 357 of movable block 353. Movable block 353 causes driving wheel 311 and follower 391 to jointly pivot away from stop face 279 of mounting seat 259 about the pivotal axis defined by axle 397. Driving toothed portion 337 of driving wheel 311 drives driven toothed portion 419 of driving member 399, pivoting driving member 399 in a reverse direction to move driving member 399 from the release position (FIGS. 5 and 6, distal end 415 is in the lower position) to the pressing position (FIGS. 9 and 10, distal end 415 is in the upper position). The slide 40 of latch device 10 abutting driving member 399 is pressed against by distal end 415 of driving member 399, moving the slide 40 towards pull rod 44 (FIGS. 9 and 10). A corresponding link 46 pivotably connected to the slide 40 pivots and pulls pull rod 44 to move along the axis parallel to the pivotal axis defined by axle 397, further moving the other slide 40 and the other link 46. Thus, latch 42 is moved by pull rod 44 from the latching position (FIG. 5) to the unlatching position (FIG. 8). Since the moving direction of handle 455 is the same as the direction for opening door 70, door 70 is opened when latch 42 has reached the unlatching position.

Figure 4:
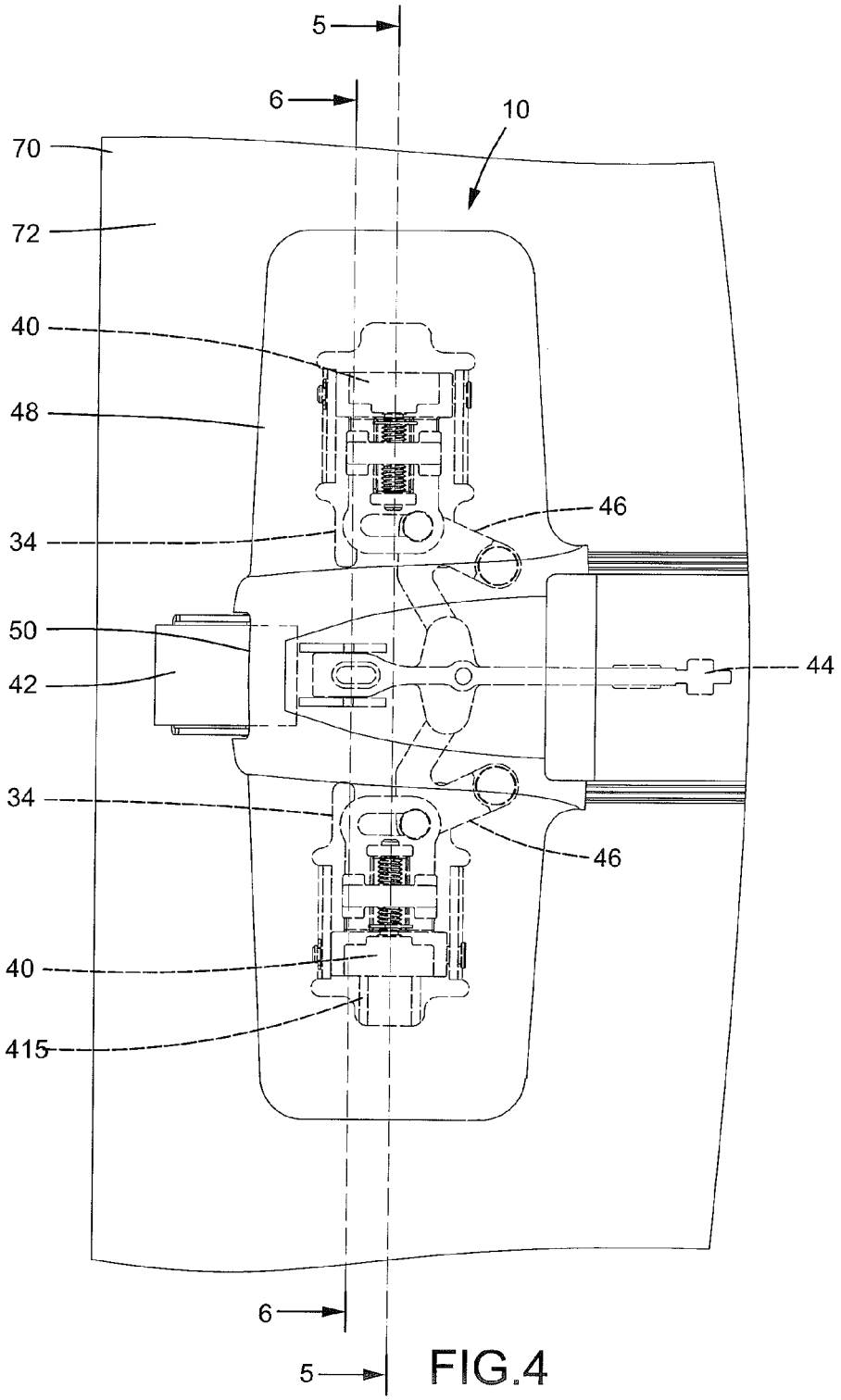
FIG. 4 is a side elevational view of the latch device mounted to an inner side of the door of FIG. 3.

When latch 42 is in the unlatching position and door 70 is open, if handle 455 is released, tension spring 535 returns movable end 471 of each lever 457 of handle 455 (movable end 471 moves towards mounting plate 211), causing pressing end 459 of each lever 457 to move away from second face 357 of movable block 353. Each slide 40 of latch device 10 is returned by a returning device of latch device 10 (each slide 40 moves away from pull rod 44). Each link 46 returns pull rod 44 by moving pull rod 44 along the axis parallel to the pivotal axis defined by axle 397 towards latch 42, moving latch 42 from the unlatching position (FIG. 8) to the latching position (FIG. 4). At the same time, the slide 40 abutting driving member 399 presses against distal end 415 of driving member 399 to pivot driving member 399 from the pressing position (FIGS. 9 and 10) to the release position (FIGS. 5 and 6). Driven toothed portion 419 of driving member 399 drives driving toothed portion 337 of driving wheel 311 to pivot driving wheel 311 in a reverse direction until stop block 335 abuts stop face 279 of mounting seat 259.

If it is desired to lock outer operating device 210 while door 70 is closed, a key is used to rotate lock core 253 of cylinder 251, and actuating block 255 of cylinder 251 presses against protrusion 395 of follower 391 (FIG. 11), causing joint movement of follower 391 and movable block 353 from the joint movement position (FIGS. 5-7 to the disengagement position (FIGS. 12-14). Compression spring 339 biases positioning member 351 to engage with second positioning groove 379 and, thus, position movable block 353 in the disengagement position. In this case, each notch 373 of movable block 353 is aligned with pressing end 459 of a corresponding lever 457 (FIG. 13). If handle 455 is pulled in this state, pressing end 459 of each lever 457 moves into a corresponding notch 373 of movable block 353. Thus, each lever 457 cannot actuate movable block 353 to pivot driving wheel 31. As a result, driving member 399 remains in the release position such that driving member 399 cannot move slides 40 of latch device 10. Accordingly, latch 42 of latch device 10 remains in the latching position. Namely, outer operating device 210 provides a locking function.

Figure 18:
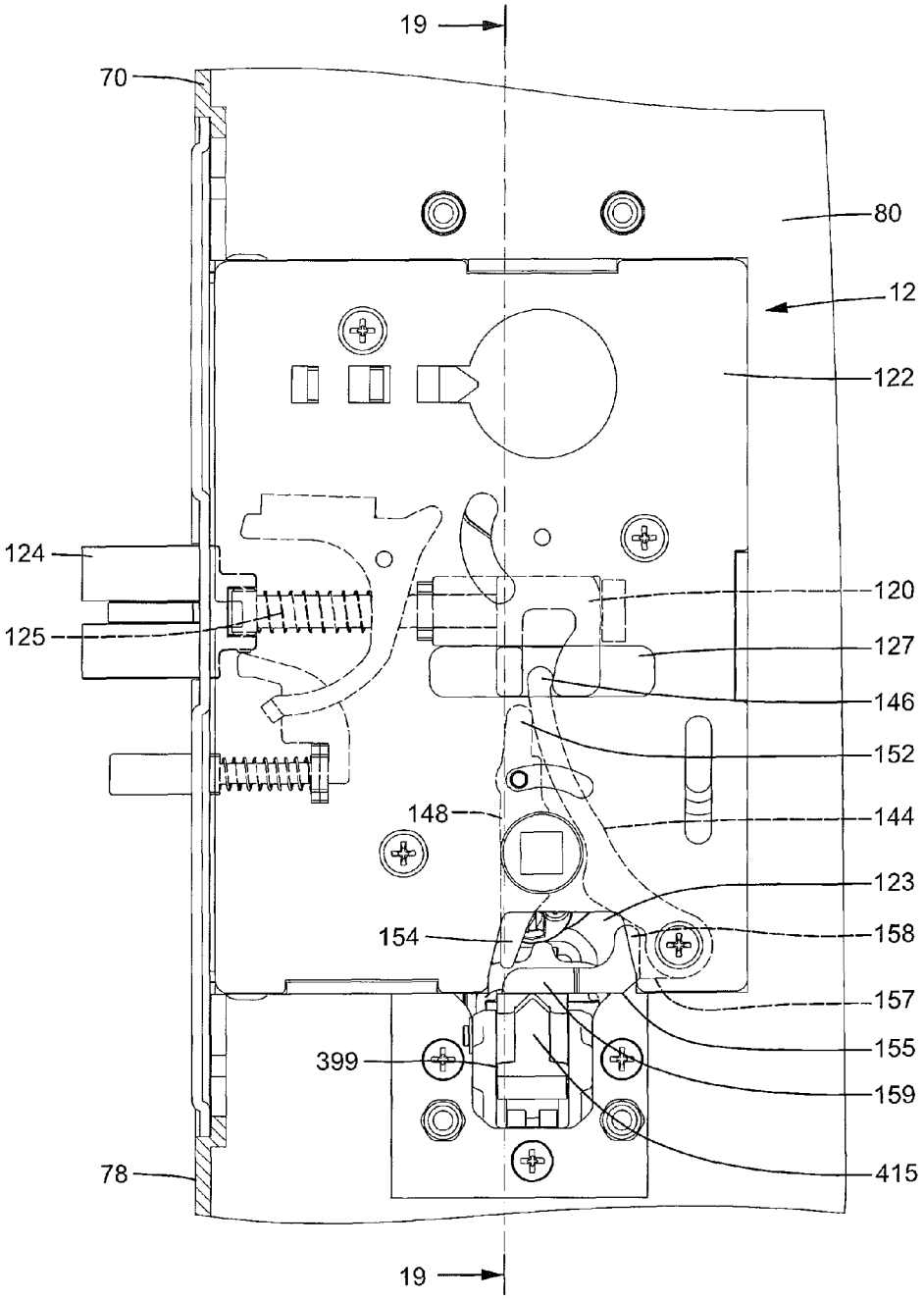
FIG. 18 is a cross sectional view taken along section line 18-18 of FIG. 17.
Figure 19:
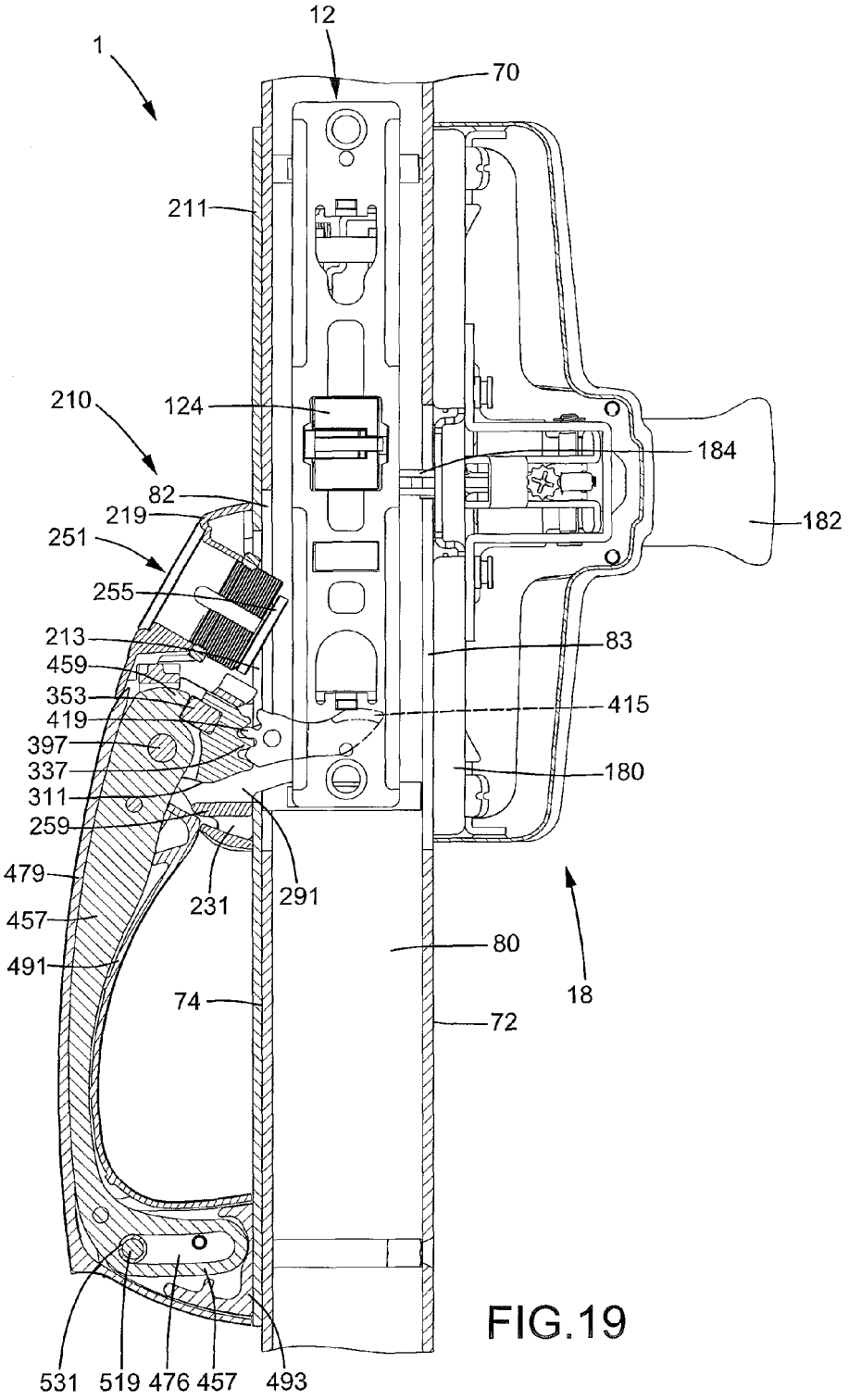
FIG. 19 is a cross sectional view taken along section line 19-19 of FIG. 18.
Figure 20:
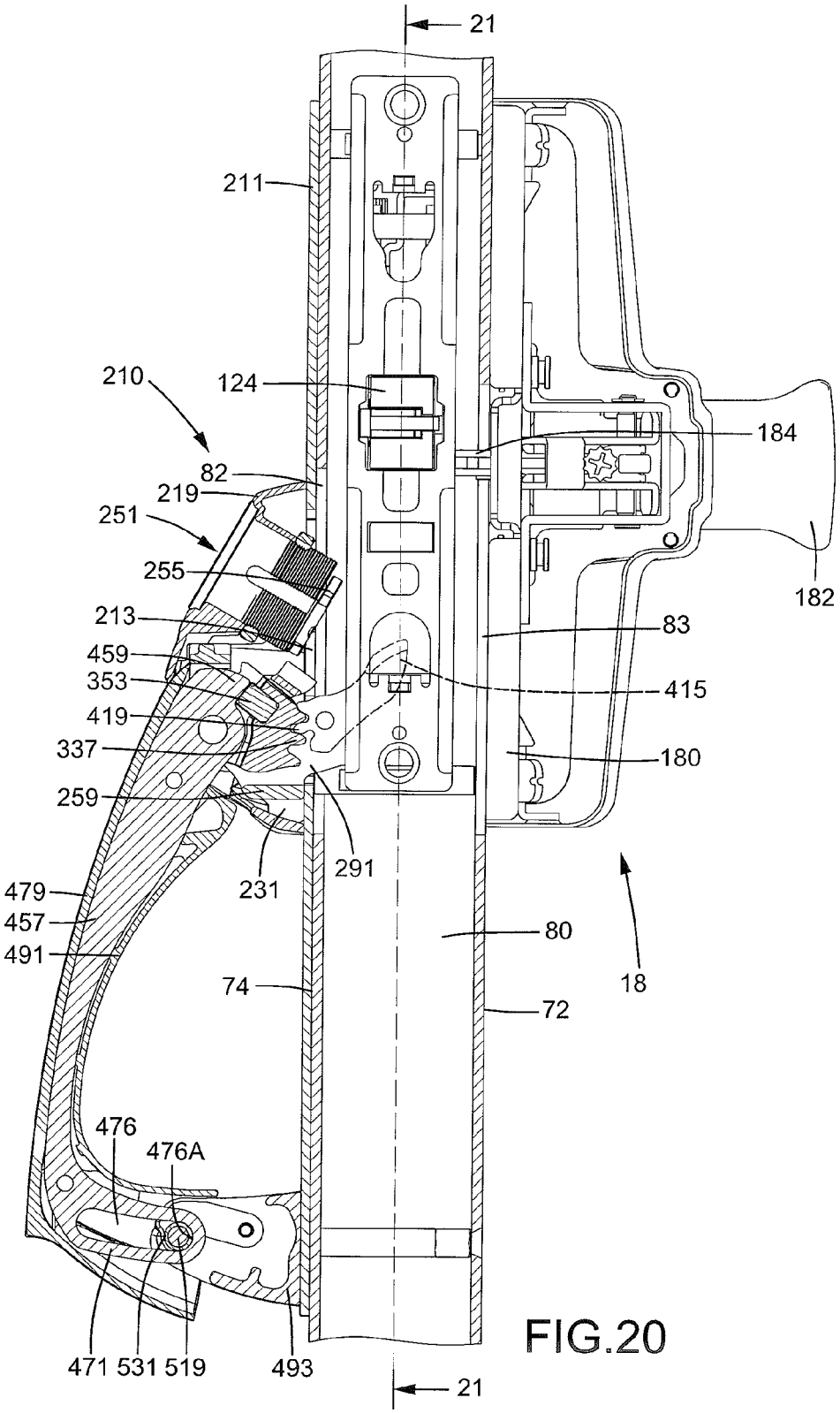
FIG. 20 is a view similar to FIG. 19 with a handle pulled.
Figure 21:
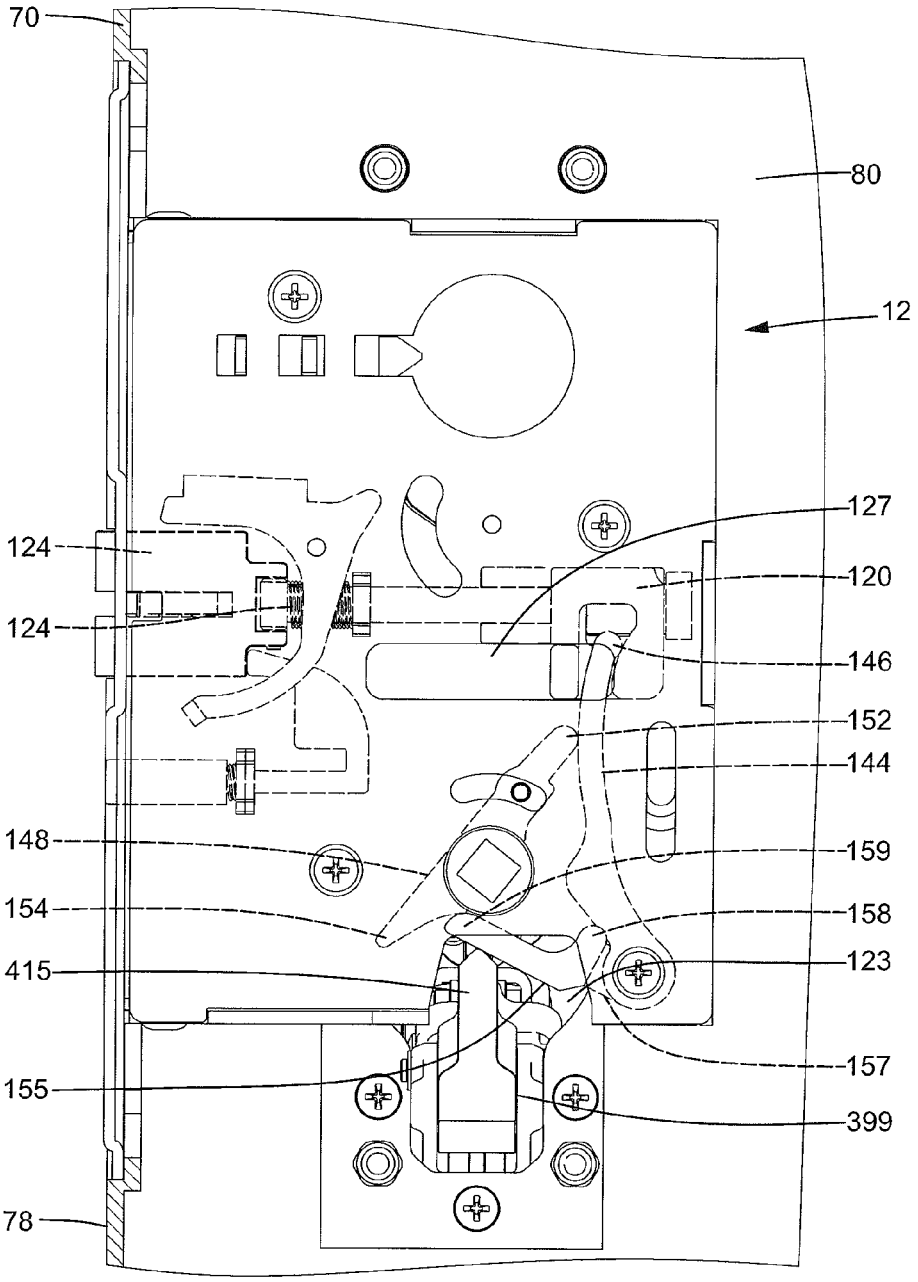
FIG. 21 is a cross sectional view taken along section line 21-21 of FIG. 20.

In addition to assembly to be of first type for matching latch device 10 mounted to inner side 72 of door 70 (see FIGS. 1-14), outer operating device 210 can be assembled to be of a second type for cooperating with latch device 12 mounted in space 80 of door 70 (see FIGS. 15-21). Outer operating device 210 of the second type is different from the first type by driving member 399. Specifically, since latch device 10 is mounted to inner side 72 of door 70 whereas latch device 12 is mounted in space 80 of door 70, a spacing between latch device 10 and outer operating device 210 of the first type is larger than a spacing between latch device 12 and outer operating device 210 of the second type. Thus, a spacing between distal end 415 of driving member 399 of outer operating device 210 of the first type and the pivotal axis defined by pivotal pin 453 is larger than a spacing between distal end 415 of driving member 399 of outer operating device 210 of the second type and the pivotal axis defined by pivotal pin 453. Namely, outer operating device 210 of the first type requires a longer driving member 399, and outer operating device 210 of the second type requires a shorter driving member 399. Furthermore, in order to match the displacement of internal components of latch device 12, the position of driving member 399 of outer operating device 210 of the second type connected to pivotal pin 453 is different from that of driving member 399 of outer operating device 210 of the first type. More specifically, the two ends of pivotal pin 453 are received in third fixing holes 299 of mounting seat 259 in outer operating device 210 of the second type (the two ends of pivotal pin 453 are received in second fixing holes 297 of mounting seat 259 in outer operating device 210 of the first type). Pivotal pin 453 is pivotably received in through-holes 435 of driving member 399 in outer operating device 210 of the second type (which is the same as the first type). Thus, driving member 399 is pivotable about the pivotal axis defined by pivotal pin 453 between the release position (FIGS. 18 and 19) and the pressing position (FIGS. 20 and 21).

With reference to FIGS. 15-21, outer operating device 210 of the second type is also mounted to outer side 74 of door 70. Latch device 12 is mounted in space 80 of door 70. Furthermore, an inner operating device 18 is mounted to inner side 72 of door 70 and is operably connected to latch device 12. Thus, door lock 1 in this embodiment is formed by outer operating device 210 of the second type, latch device 12, and inner operating device 18.

Latch device 12 includes a case 122 mounted in space 80 and having an opening 123. Case 122 further includes a sliding slot 127. A retractor 120 is slideably received in case 122 and has a portion slideably received in sliding slot 127. A spring 125 is mounted between retractor 120 and a latch 124, permitting latch 124 to move between a latching position outside of case 122 and an unlatching position in case 122.

An unlocking member 148 is pivotably mounted in case 122, is located below latch 124, and includes first and second ends 152 and 154. A push rod 144 is mounted in case 122 and abuts unlocking member 148. Push rod 144 is arcuate and includes an end 146 abutting retractor 120. The other end of push rod 144 is pivotably connected to case 122. First end 152 of unlocking member 148 abuts push rod 144. Second end 154 of unlocking member 148 is received in opening 123.

A pressing member 155 is mounted in case 122 and is located below unlocking member 148 and push rod 144. Pressing member 155 includes a pivotal end 157 pivotably connected to case 122, a first pressing end 158 located adjacent to pivotal end 157, and a second pressing end 159 distant to pivotal end 157. First pressing end 158 of pressing member 155 abuts a lower portion of push rod 144. Second pressing end 159 of pressing member 155 is located in opening 123 of case 12 and is located below second end 154 of unlocking member 148 (FIG. 18). Thus, when pressing member 155 pivots in a clockwise direction in FIG. 18, first pressing end 158 of pressing member 155 drives push rod 144 to pivot, which, in turn, moves latch 124 from the latching position to the unlatching position. Furthermore, second pressing end 159 of pressing member 155 pushes second end 154 of unlocking member 148 to pivot unlocking member 148 in the counterclockwise direction (FIG. 21).

Inner operating device 18 includes a base 180 and a driving rod 184 pivotably connected to base 180. A press bar 182 is mounted to base 180 and coupled to driving rod 184, permitting joint movement of press bar 182 and driving rod 184. An end of driving rod 184 extends through second opening 83 of door 70 and sliding groove 127 into case 122 and abuts retractor 120. When press bar 182 is pressed to pivot driving rod 184, retractor 120 is moved to retract latch 124 from latching position to the unlatching position for unlatching purposes.

With reference to FIGS. 15-21, distal end 415 of driving member 399 of outer operating device 210 of the second type extends through first opening 82 of door 70 into space 80 and abuts a bottom of second pressing end 159 of pressing member 155 of latch device 12. When driving member 399 pivots from the release position to the pressing position, the pressing member 155 is driven to pivot in the counterclockwise direction.

For the sake of explanation, it will be assumed that movable block 353 of outer operating device 210 of the second type is in the joint movement position (FIG. 19), door 70 is closed, and latch 124 of latch device 12 is in the latching position.

In a case that handle 455 is pulled away from mounting plate 211, driving wheel 311 drives driving member 399 to pivot driving member 399 from the release position (FIG. 19) to the pressing position (FIG. 20). Distal end 415 of driving member 399 drives pressing member 155 of latch device 12 to pivot in the clockwise direction, which, in turn, pushes unlocking member 148 and push rod 144 to pivot jointly. End 146 of push rod 144 actuates retractor 120 to move latch 124 from the latching position (FIG. 18) to the unlatching position (FIG. 21) while compressing spring 125. Door 70 is then opened.

When latch 124 of latch device 12 is in the unlatching position and door 70 is open, if handle 455 is released, tension spring 535 returns handle 455, and spring 125 biases and returns latch 124 to the latching position. Furthermore, push rod 144 pivots to return unlocking member 148 and pressing member 155. Thus, pressing member 155 presses against distal end 415 of driving member 399 and, thus, pivots driving member 399, which, in turn, returns driving wheel 311 to a position in which stop block 335 abuts stop face 279 of mounting seat 259 (FIG. 19).

During operation of handle 455 for moving latch 42 of latch device 10 (if outer operating device 210 is of the first type) or latch 124 of latch device 12 (if outer operating device 210 of the second type) from the latching position to the unlatching position, the moving direction of handle 455 is the same as the opening direction of door 70. Thus, door 70 is opened when latch 42 or latch 124 reaches the unlatching position, which is convenient to operation.

After outer operating device 210 of either first type or second type is locked, operating handle 455 cannot actuate driving wheel 311 and driving member 399, avoiding damage to outer operating device 210 from external force.

By changing driving member 399 of different lengths and by changing the pivotal position of driving member 399, outer operating device 210 can be assembled to be of the first type or the second type according to needs and can match different latch devices 10 and 12, providing high utility and reducing manufacturing costs.

Now that the basic teachings of the present invention have been explained, many extensions and variations will be obvious to one having ordinary skill in the art. For example, follower portion 417 and driving portion 411 of driving member 399 can be integrally formed. In another approach, driving portion 411 can be an extension extending from an outer periphery of follower portion 417. Furthermore, handle 455 can include only one movable block 353, and movable block 353 can include only one notch 373 in second face 357.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An outer operating device for a door lock comprising:

a mounting plate including a through-hole, with the mounting plate adapted to be mounted to an outer side of a door;

a casing fixed to the mounting plate and aligned with the through-hole, with the casing including a first installation space and a second installation space;

a mounting seat fixed to the mounting plate and located in the first installation space of the casing, with the mounting seat including a first pivotal end, a second pivotal end, and a stop end, with the first pivotal end located between the stop end and the second pivotal end, and with the mounting seat further including an installation space;

a cylinder mounted in the second installation space of the casing, with the cylinder including a lock core and an actuating block coupled to the lock core, wherein the actuating block is pivotable when the lock core is in an unlocked state;

a driving wheel pivotably mounted in the installation space of the mounting seat and located on the first pivotal end of the mounting seat, with the driving wheel including first and second sides and an outer periphery extending between the first and second sides, with a stop block and a driving toothed portion formed on the outer periphery of the driving wheel and spaced from each other in a circumferential direction about a pivotal axis about which the driving wheel pivots, with the driving wheel further including a track extending from the first side through the second side of the driving wheel, with the driving toothed portion of the driving wheel facing the second pivotal end of the mounting seat, and with the stop block facing the stop end of the mounting seat;

a movable block slideably received in the track of the driving wheel, with the movable block including a first face and a second face opposite to the first face, with the movable block further including a notch in the second face, with the movable block movable along the track between a joint movement position and a disengagement position;

a follower coupled to the movable block, with the follower jointly movable with the movable block, with the follower including a protrusion extending beyond the mounting seat, wherein when the actuating block of the cylinder pivots to presses against and move the protrusion of the follower, the movable is driven to move between the joint movement position and the disengagement position;

a driving member pivotably mounted in the installation space of the mounting seat and located on the second pivotal end of the mounting seat, with the driving member including a follower portion and a driving portion, with the driving portion including a distal end distant to the follower portion, with the driving member including a driven toothed portion meshed with the driving toothed portion of the driving wheel, with the distal end of the driving member moving between a pressing position and a release position when the driving wheel pivots, with the distal end of the driving member adapted to couple with a latch device mounted to the door, with a latch of the latch device adapted to be in an unlatching position when the driving member is in the pressing position, and with the latch of the latch device adapted to be in a latching position when the driving member is in the release position; and a lever pivotably connected to the first pivotal end of the mounting seat, with the lever including a pressing end located on the casing and a movable end located outside of the casing, with the lever further including an axle hole adjacent to the pressing end, with the axle hole of the lever pivotably connected to the first pivotal end of the mounting seat, and with the pressing end of the lever aligned with the movable block, wherein when the driving member is in the release position, the stop block of the driving wheel abuts the stop end of the mounting seat, wherein when the driving member is in the pressing position, the stop block of the driving wheel is spaced from the stop end of the mounting seat in a circumferential direction about the pivotal axis of the driving wheel, wherein when the movable block is in the joint movement position, the pressing end of the lever is not aligned with the notch of the movable block, wherein when the movable block is in the disengagement position, the pressing end of the lever is aligned with the notch of the movable block, wherein when the movable block is in the joint movement position and when the driving member is in the release position, if the lever is pivoted, the pressing end of the lever presses against the second face of the movable block, causing pivotal movement of the driving wheel to pivot the driving member from the release position to the pressing position, and wherein when the movable block is in the disengagement position and when the driving member is in the release position, if the lever is pivoted, the pressing end of the lever moves into the notch of the movable block, and the driving wheel and the driving member are not moved.

2. The outer operating device as claimed in claim 1, with the driving wheel further including an axle hole extending from the first side through the second side of the driving wheel, with the driving member further including a through-hole between the driven toothed portion and the distal end, with the mounting seat further including a first fixing hole in the first pivotal end, a second fixing hole in the second pivotal end, and a third fixing hole located between the first fixing hole and the second fixing hole, with the outer operating device further comprising:

an axle mounted in the first fixing hole of the mounting seat and pivotably received in the axle hole of the driving wheel and the axle hole of the lever permitting the driving wheel and the lever to pivot about a pivotal axis defined by the axle; and a pivotal pin selectively mounted in one of the second fixing hole and the third fixing hole, with the pivotal pin pivotably received in the through-hole of the driving member, with the pivotal pin defining the pivotal axis of the driving member, wherein when the pivotal pin is mounted in the second fixing hole, the latch device coupled to the driving member is adapted to be mounted to an inner side of the door, and wherein when the pivotal pin is mounted in the third fixing hole, the latch device coupled to the driving member is adapted to be mounted in a space between the inner and outer sides of the door.

3. The outer operating device as claimed in claim 1, with the lever further including a limiting slot in the movable end, with the limiting slot having an end, with the outer operating device further comprising:

a coupling seat fixed to the mounting plate; and a first fixing pin extending through the limiting slot of the lever and inserted into the coupling seat, wherein when the driving member is in the pressing position, the first fixing pin abuts the end of the limiting slot of the lever.

4. The outer operating device as claimed in claim 3, with the coupling seat further including an extension having a chamber, with the first fixing pin extending into the extension of the coupling seat and spaced from the chamber, with the outer operating device further comprising:

a first connecting member fixed to the lever and located adjacent to the limiting slot;

a tension spring mounted in the chamber of the coupling seat, with the tension spring including a first end attached to the first connecting member and a second end received in the chamber; and a second fixing pin extending through the extension into the chamber of the coupling seat, with the second end of the tension spring attached to the second fixing pin, wherein when the lever pivots and causes pivotal movement of the driving member from the release position to the pressing position, the first connecting member pulls the tension spring to provide a returning force.

5. The outer operating device as claimed in claim 1, with the driving wheel further including a groove in the bottom face of the track, with the movable block further including a lower face extending between the first and second faces of the movable block, with the lower face facing the bottom face of the track, with the movable block further including first and second positioning grooves defined in the lower face and spaced from each other, with the outer operating device further comprising:

a positioning member received in the groove of the driving wheel; and a compression spring received in the groove of the driving wheel and biasing the positioning member, wherein when the movable block is in the joint movement position, the first positioning groove of the movable block is aligned with the groove of the driving wheel, and the compression spring biases the positioning member to engage with the first positioning groove of the movable block, and wherein when the movable block is in the disengagement position, the second positioning groove of the movable block is aligned with the groove of the driving wheel, and the compression spring biases the positioning member to engage with the second positioning groove of the movable block.

* * * * *